US009930934B2

(12) United States Patent
Cook et al.

(10) Patent No.: US 9,930,934 B2
(45) **Date of Patent: *Apr. 3, 2018**

(54) ARTICLE OF FOOTWEAR WITH A SEGMENTED PLATE

(71) Applicant: NIKE, Inc., Beaverton, OR (US)

(72) Inventors: Christopher S. Cook, Portland, OR (US); David J. Roulo, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 45 days.

This patent is subject to a terminal disclaimer.

(21) Appl. No.: 14/790,929

(22) Filed: Jul. 2, 2015

(65) Prior Publication Data

US 2016/0000185 A1 Jan. 7, 2016

Related U.S. Application Data

(60) Provisional application No. 62/020,559, filed on Jul. 3, 2014.

(51) Int. Cl.

| | |
|---|---|
| ***A45C 15/02*** | (2006.01) |
| ***A43C 15/16*** | (2006.01) |
| ***A43B 5/06*** | (2006.01) |
| ***A43B 13/02*** | (2006.01) |
| ***A43B 13/12*** | (2006.01) |
| ***A43B 13/14*** | (2006.01) |
| ***A43B 13/16*** | (2006.01) |
| ***A43B 13/22*** | (2006.01) |
| ***A43B 13/26*** | (2006.01) |
| ***A43C 15/02*** | (2006.01) |

(52) U.S. Cl.

CPC ..... *A43C 15/16* (2013.01); *A43B 5/06* (2013.01); *A43B 13/026* (2013.01); *A43B 13/12* (2013.01); *A43B 13/122* (2013.01); *A43B 13/141* (2013.01); *A43B 13/16* (2013.01); *A43B 13/223* (2013.01); *A43B 13/26* (2013.01); *A43C 15/02* (2013.01)

(58) Field of Classification Search

CPC ..... A43B 13/26; A43B 13/122; A43B 13/12; A43B 13/42; A43B 13/16; A43B 13/10; A43B 13/41; A43B 13/02; A43B 13/14; A43B 13/141; A43B 5/06

USPC ..... 36/107, 126, 127, 128, 129, 182, 25 R, 36/31, 108

See application file for complete search history.

(56) References Cited

U.S. PATENT DOCUMENTS 3,127,687 A * 4/1964 Hollister ..... A43C 13/04 36/107

3,748,756 A * 7/1973 White ..... A43B 3/26 36/69

(Continued)

*Primary Examiner* — Jameson Collier

*Assistant Examiner* — Heather Mangine

(74) *Attorney, Agent, or Firm* — Honigman Miller Schwartz and Cohn LLP; Matthew H. Szalach; Jonathan P. O'Brien

(57) ABSTRACT

An article of footwear including a sole having a first plate and a second plate. The first plate extends from a forefoot portion of the article of footwear to a heel portion of the article of footwear. The second plate extends from the forefoot portion of the article of footwear to a midfoot portion of the article of footwear. The first plate and the second plate may be spaced apart from one another and may improve an amount of energy return while turning by increasing a rigidity of the sole.

21 Claims, 19 Drawing Sheets

(56) References Cited

U.S. PATENT DOCUMENTS 4,307,521 A * 12/1981 Inohara ..... A43B 13/12 36/31
4,787,156 A * 11/1988 Bade ..... B29D 35/081 12/142 T
4,858,343 A * 8/1989 Flemming ..... A43B 13/26 36/128
5,384,973 A * 1/1995 Lyden ..... A43B 13/12 36/102
5,461,801 A * 10/1995 Anderton ..... A43B 3/0052 24/713.4
5,473,827 A * 12/1995 Barre ..... A43B 5/02 36/128
5,647,145 A * 7/1997 Russell ..... A43B 3/0052 36/25 R
5,709,954 A * 1/1998 Lyden ..... A43B 5/00 12/142 R
6,145,221 A * 11/2000 Hockerson ..... A43B 5/02 36/126
6,412,196 B1 * 7/2002 Gross ..... A43B 13/026 36/102
6,418,641 B1 * 7/2002 Schenkel ..... A43B 13/12 36/102
6,421,933 B1 * 7/2002 Zamprogno ..... A43B 5/02 36/114
6,789,332 B1 * 9/2004 Scholz ..... A43B 7/1425 36/103
6,857,205 B1 * 2/2005 Fusco ..... A43B 5/00 36/102
6,915,596 B2 * 7/2005 Grove ..... A43B 13/223 36/100
6,954,998 B1 * 10/2005 Lussier ..... A43B 5/02 36/107
6,973,745 B2 * 12/2005 Mills ..... A43B 3/0068 36/113
7,096,605 B1 * 8/2006 Kozo ..... A43B 7/08 36/103
7,121,020 B1 * 10/2006 Bathum ..... A43B 3/128 36/102
7,181,868 B2 * 2/2007 Auger ..... A43B 5/02 36/103
7,866,064 B2 * 1/2011 Gerber ..... A43C 15/161 36/100
8,056,267 B2 * 11/2011 Auger ..... A43B 5/02 36/114
8,099,880 B2 * 1/2012 Brewer ..... A43B 7/24 36/25 R
8,181,364 B2 * 5/2012 Mayden ..... A43B 7/144 36/103
8,365,440 B2 * 2/2013 Rivas ..... A43B 3/0036 36/107
8,782,928 B2 * 7/2014 Amos ..... A43B 13/141 36/102
8,984,775 B2 * 3/2015 Dombrow ..... A43B 23/0295 36/102
9,032,645 B2 * 5/2015 Stauffer ..... A43C 15/00 36/67 R
9,510,647 B1 * 12/2016 Singh ..... A43B 13/41
9,591,891 B1 * 3/2017 Baucom ..... A43B 13/14
9,713,357 B2 * 7/2017 Denison ..... A43B 5/001
9,717,304 B2 * 8/2017 Bernhard ..... A43B 13/125
2002/0092207 A1 * 7/2002 Girard ..... A43B 5/0411 36/117.3
2002/0144429 A1 * 10/2002 Hay ..... A43B 7/1425 36/25 R
2004/0055182 A1 * 3/2004 Manz ..... A43B 13/12 36/115
2005/0016029 A1 * 1/2005 Auger ..... A43B 1/0072 36/134
2007/0068039 A1 * 3/2007 Nau ..... A43B 3/0036 36/25 R
2008/0141562 A1 * 6/2008 Peveto ..... A43B 7/142 36/91
2008/0250673 A1 * 10/2008 Andrews ..... A43B 13/12 36/25 R
2009/0113765 A1 * 5/2009 Robinson, Jr. ..... A43B 3/0078 36/127
2009/0172971 A1 * 7/2009 Peikert ..... A43B 7/125 36/88
2009/0205224 A1 * 8/2009 Rosenbaum ..... A43B 13/141 36/25 R
2010/0319111 A1 * 12/2010 Berns ..... A41D 27/24 2/440
2011/0010964 A1 * 1/2011 Hardy ..... A43B 13/36 36/103
2011/0030245 A1 * 2/2011 Truelsen ..... A43B 5/06 36/30 R
2011/0078927 A1 * 4/2011 Baker ..... A43B 13/26 36/134
2011/0088287 A1 * 4/2011 Auger ..... A43B 5/02 36/107
2011/0185590 A1 * 8/2011 Nishiwaki ..... A43B 5/06 36/28
2011/0252671 A1 * 10/2011 Maron ..... A43B 3/0057 36/30 R
2011/0289801 A1 * 12/2011 Amos ..... A43B 13/141 36/134
2011/0302809 A1 * 12/2011 Kim ..... A43B 13/127 36/103
2012/0060395 A1 * 3/2012 Blevens ..... A43B 1/0072 36/30 R
2012/0174432 A1 * 7/2012 Peyton ..... A43B 13/125 36/28
2012/0279091 A1 * 11/2012 Baucom ..... A43B 3/0042 36/67 A
2012/0285044 A1 * 11/2012 Bacon ..... A43B 5/001 36/103
2012/0324762 A1 * 12/2012 Soumokil ..... A43B 1/0027 36/103
2013/0067765 A1 * 3/2013 Auger ..... A43B 5/02 36/31
2013/0067771 A1 * 3/2013 Minami ..... A43B 13/223 36/103
2013/0139412 A1 * 6/2013 Auger ..... A43B 1/0009 36/25 R
2013/0199057 A1 * 8/2013 Hurd ..... A43B 7/14 36/88
2013/0318824 A1 * 12/2013 Auger ..... A43B 3/0036 36/88
2013/0318831 A1 * 12/2013 Foxen ..... A43B 5/02 36/25 R
2013/0326911 A1 * 12/2013 Baucom ..... A43B 13/122 36/103
2013/0333248 A1 * 12/2013 Auger ..... A43B 3/0052 36/134
2014/0026444 A1 * 1/2014 Howley ..... A43B 13/14 36/134
2014/0082969 A1 * 3/2014 Binzer ..... A43B 13/22 36/107
2014/0182169 A1 * 7/2014 Mack ..... A43B 9/04 36/102
2014/0215857 A1 * 8/2014 Curl ..... A43B 5/001 36/134
2014/0259786 A1 * 9/2014 Heard ..... A43B 13/14 36/103
2014/0283413 A1 * 9/2014 Christensen ..... A43B 3/0057 36/102
2015/0013185 A1 * 1/2015 Elder ..... A43B 13/14 36/83
2015/0040436 A1 * 2/2015 Clerc ..... A43B 13/02 36/103
2015/0089841 A1 * 4/2015 Smaldone ..... A43B 5/00 36/103
2015/0096198 A1 * 4/2015 Cavaliere ..... A43B 5/02 36/103
2015/0189947 A1 * 7/2015 Klug ..... A43C 1/04 36/103
2015/0223561 A1 * 8/2015 Kilgore ..... A43B 13/14 36/25 R

(56) References Cited

U.S. PATENT DOCUMENTS

2015/0272268 A1* 10/2015 Abshire ..... A43B 13/141 36/25 R
2015/0282557 A1* 10/2015 Kirk ..... A43B 13/141 36/31
2015/0305447 A1* 10/2015 Cavaliere ..... A43C 15/161 36/66
2015/0327624 A1* 11/2015 Grott ..... A43B 7/14 36/91
2015/0351492 A1* 12/2015 Dombrow ..... A43B 13/122 36/102
2015/0366289 A1* 12/2015 Rustam ..... A43B 13/188 36/127
2016/0000180 A1* 1/2016 Cook ..... A43B 5/06 36/103
2016/0015120 A1* 1/2016 Denison ..... A43B 3/0094 36/127
2016/0021972 A1* 1/2016 Grelle ..... A43B 7/1415 36/140
2016/0021977 A1* 1/2016 Madore ..... A43B 5/001 36/30 R
2016/0081427 A1* 3/2016 Iuchi ..... A43B 13/026 36/28
2016/0120263 A1* 5/2016 Cortez ..... A43B 13/127 36/29
2016/0174656 A1* 6/2016 Wolfrom ..... A43B 13/122 36/28
2016/0198792 A1* 7/2016 Chen ..... A43B 5/14 36/31
2016/0353836 A1* 12/2016 Luedecke ..... A43B 13/122
2017/0079373 A1* 3/2017 Huard ..... A43B 13/127
2017/0099910 A1* 4/2017 Howley ..... A43B 13/14
2017/0196305 A1* 7/2017 Barnes ..... A43B 13/141
2017/0202305 A1* 7/2017 Huard ..... A43B 13/127
2017/0208893 A1* 7/2017 Garbujo ..... A43B 5/0413

* cited by examiner

ARTICLE OF FOOTWEAR WITH A SEGMENTED PLATE

CROSS REFERENCE TO RELATED APPLICATIONS

This application Claims the benefit of U.S. Provisional Patent Application Ser. No. 62/020,559, filed Jul. 3, 2014, the entire contents of which are hereby incorporated by reference.

FIELD

The present disclosure relates generally to an article of footwear for track events and methods of making an article of footwear.

BACKGROUND

This section provides background information related to the present disclosure which is not necessarily prior art.

Conventional articles of footwear used in track and field events are typically constructed with a flexible sole structure having one or more cleats or spikes that aid an athlete in gripping the ground during use. For example, conventional articles of footwear used in track and field events have an outsole formed from foam or rubber and a series of metal spikes extending from the outsole. The foam or rubber material provides the article of footwear with a degree of flexibility while the spikes increase the ability of the article of footwear to grip the ground during use. Such increases in flexibility and grip aid the athlete during running, jumping, and lateral (i.e., side-to-side) movements.

While conventional articles of footwear used in track and field events adequately provide an athlete with flexibility and grip, such articles do not provide energy return to the athlete. Namely, when the sole structure of a conventional article bends, the general flexibility of the sole structure does not store a significant amount of energy. This is due in large part to the nature of the materials used in constructing the sole structure, as these materials are relatively flexible and, as such, require little energy to bend from a rest position to a flexed position. Accordingly, little energy is stored in making such movements and, therefore, little energy can be returned to the athlete when the sole structure is returned from the flexed position to the rest position.

BRIEF DESCRIPTION OF THE DRAWINGS

The configurations can be better understood with reference to the following drawings and description. The components in the figures are not necessarily to scale, emphasis instead being placed upon illustrating the principles of the configurations. Moreover, in the figures, like reference numerals designate corresponding parts throughout the different views.

DESCRIPTION

Figure 1:
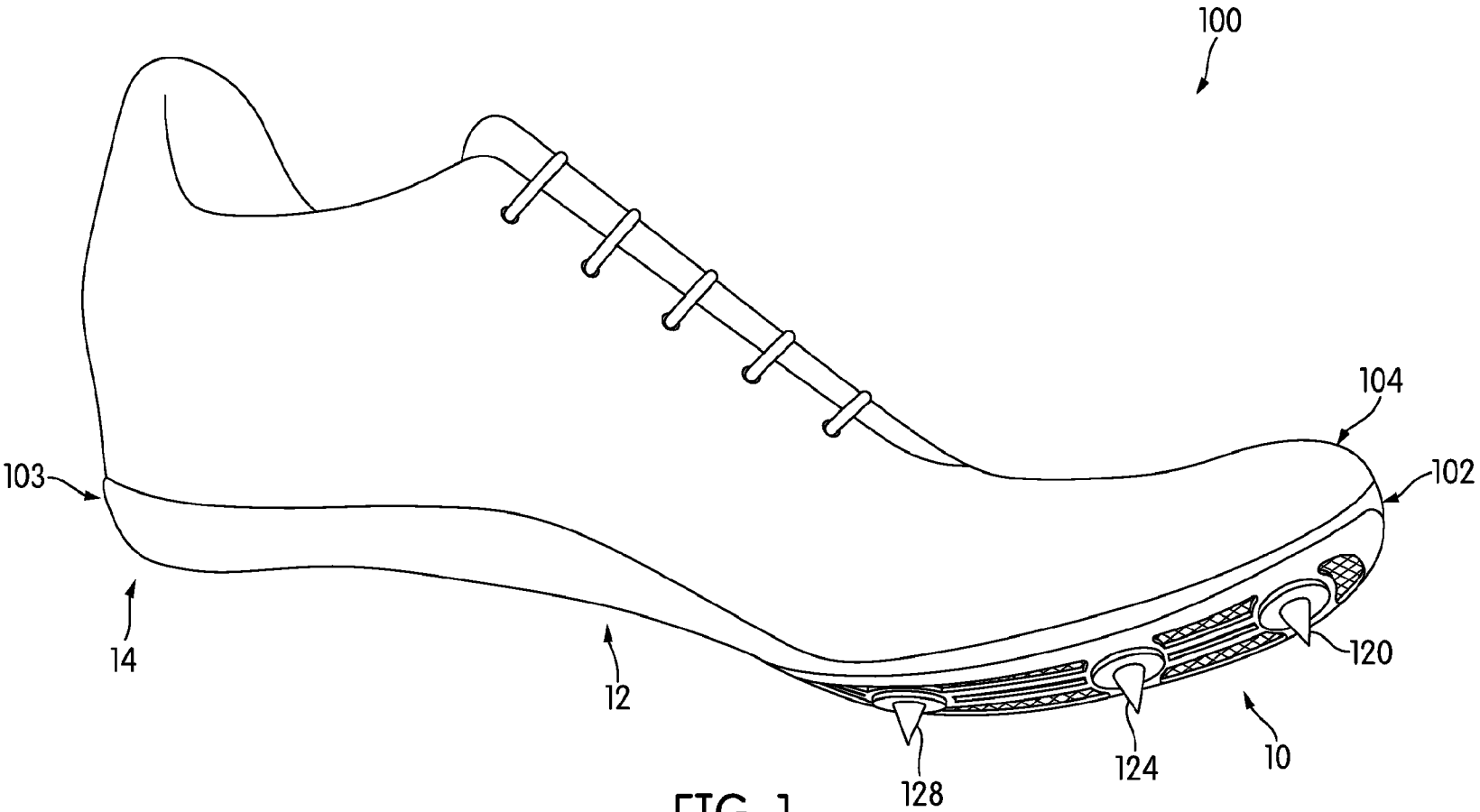
FIG. 1 is a side view of an exemplary configuration of an article of footwear having a sole plate.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The following description discusses an exemplary configuration in the form of an article of footwear for use during a track and field event. However, it should be noted that the present concept may be associated with any article of footwear, including, but not limited to, articles of footwear intended for use while playing baseball, rugby, and/or football. The articles of footwear shown in the figures may be intended to be used with a left foot. However, it should be understood that the following discussion may apply to mirror images of the articles of footwear that may be intended to be used with a right foot.

An article of footwear is disclosed. The article of footwear may generally include a sole comprising a first plate and a second plate. The first plate and second plate may have contours to allow flexing in the lateral direction of the article of footwear. For example, the first plate may have a first edge having a first contour corresponding to a second contour of a second edge of the second plate. Moreover, the first contour may have a shape to further improve flexing in the lateral direction of the article of footwear. For example, the first contour may include a transition segment extending between a medial axis and a lateral axis. The article of footwear may facilitate improved energy return while running.

The article of footwear includes a sole comprising a first plate and a second plate, wherein the first plate is spaced from the second plate. The first plate extends from a forefoot portion of the article of footwear to a heel portion of the article of footwear. The second plate extends from the forefoot portion of the article of footwear to a midfoot portion of the article of footwear. The first plate includes a first edge and the second plate includes a second edge, wherein the first edge faces the second edge. The first edge has a first contour corresponding to a second contour of the second edge. The first plate and second plate may improve an amount of energy return while running by increasing a rigidity of the sole.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole.

The article of footwear including the first plate and the second plate may also be configured so that the first plate includes a first rigid member that may extend from the forefoot portion to the heel portion. Moreover, the second plate may include a second rigid member extending from the forefoot portion to the midfoot portion.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion.

The article of footwear including the first plate and the second plate may also be configured so that the first plate includes a first rigid member that may extend from the forefoot portion to the heel portion. Moreover, the second plate may include a second rigid member extending from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge.

The article of footwear including the first plate and the second plate may also be configured so that the first plate includes a first rigid member that extends from the forefoot portion to the heel portion. Moreover, the second plate may include a second rigid member extending from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and wherein the central region also includes a third edge. Moreover, the second edge may be opposite to the third edge. Further, the third edge may have a third contour corresponding to the first contour of the first edge. Additionally, the lateral region may include a fourth edge, the fourth edge facing the third edge. Moreover, the fourth edge may have a fourth contour corresponding to the second contour of the second edge.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge.

The article of footwear including the first plate and the second plate may also be configured so that the first plate includes a first rigid member that extends from the forefoot portion to the heel portion. Moreover, the second plate may include a second rigid member extending from the forefoot portion to the midfoot portion. Additionally, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the first plate may include a first rigid member that may extend from the forefoot portion to the heel portion. Additionally, the second plate may include a second rigid member, the second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member and/or the third rigid member may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge. Further the first plate may include a first set of cleats that may be disposed under the first rigid member. Additionally, the second plate may include a second set of cleats that may be disposed under the second rigid member and the third rigid member.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge. Further, the first plate may include a first set of cleats that may be disposed under the first rigid member. Additionally, the second plate may include a second set of cleats that may be disposed under the second rigid member and the third rigid member. Further, the first rigid member may be attached to the first set of cleats by an elastomer. Additionally, the second rigid member and the third rigid member may be attached to the second set of cleats by the elastomer.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge. Further, the first plate may include a first set of cleats that may be disposed under the first rigid member. Additionally, the second plate may include a second set of cleats that may be disposed under the second rigid member and the third rigid member. Further, the first rigid member may be attached to the first set of cleats by an elastomer. Additionally, the second rigid member and the third rigid member may be attached to the second set of cleats by the elastomer. Further, the first plate may include a rib, the rib extending from an outer surface of the first rigid member. Moreover, the rib may be formed of the elastomer.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge. Further, the first plate may include a first set of cleats that may be disposed under the first rigid member. Additionally, the second plate may include a second set of cleats that may be disposed under the second rigid member and the third rigid member. Further, the first rigid member may be attached to the first set of cleats by an elastomer. Additionally, the second rigid member and the third rigid member may be attached to the second set of cleats by the elastomer. Further, the first plate may include a rib, the rib extending from an outer surface of the first rigid member. Moreover, the rib may be formed of the elastomer. Additionally, the rib may have a contour corresponding to a shape of the first plate.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge. Further, the second rigid member and the third rigid member may be monolithic.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge. Further, the article of footwear may include a midsole comprising an upper surface and a lower surface, whereby the lower surface of the midsole is attached to the sole. Moreover, the article of footwear may include an upper attached to the upper surface of the midsole. Additionally, the lower surface of the midsole may be exposed between the first edge and the second edge.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that extends from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge. Further, the first rigid member may be carbon fiber.

The article of footwear including the first plate and the second plate may also be configured so that the first edge includes a forefoot segment, a transition segment, and a midfoot segment. Moreover, the transition segment may extend between the forefoot segment and the midfoot segment. Additionally, the forefoot segment may extend along a medial axis. Further, the midfoot segment may extend along a lateral axis. Additionally, the transition segment may extend between the medial axis and the lateral axis. Moreover, the medial axis may extend in a substantially longitudinal direction along a medial side of the sole. Further, the lateral axis may extend in the substantially longitudinal direction along a lateral side of the sole. Moreover, the first plate may include a first rigid member that may extend from the forefoot portion to the heel portion. Additionally, the second plate may include a second rigid member extending from the forefoot portion to the midfoot portion. Further, the first rigid member may extend along the first contour and/or the first rigid member may maintain a substantially constant first distance from the first edge. Moreover, the second rigid member may extend along the second contour and/or the second rigid member may maintain a substantially constant second distance from the second edge. Further, the second plate may include a central region and a lateral region. Additionally, the central region may include the second edge and a third edge. The second edge may be opposite to the third edge. Further, the third edge may have a third contour corresponding to the first contour of the first edge. Additionally, the lateral region may include a fourth edge that faces the third edge. Moreover, the fourth edge may have a fourth contour corresponding to the second contour of the second edge. Furthermore, the second plate may include a third rigid member that may extend from the forefoot portion to the midfoot portion. Additionally, the third rigid member may extend along the fourth contour and/or the third rigid member may maintain a substantially constant fourth distance from the fourth edge. Moreover, the second rigid member may extend along the third contour and/or the second rigid member may maintain a substantially constant third distance from the third edge. Further, the first plate may include a forefoot region, a transition region, and a midfoot region. Additionally, the transition region may extend between the forefoot region and the midfoot region. Moreover, the midfoot region may extend from an exposed lateral edge of the sole to an exposed medial edge of the sole. Additionally, the forefoot region may extend from first edge to the exposed medial edge of the sole. Further, the transition region may extend from first edge to the exposed medial edge of the sole. Moreover, the second plate may extend from the exposed lateral edge of the sole to the second edge.

A method of manufacturing an article of footwear is disclosed. The method includes providing a sole comprising a first plate and a second plate. The first plate is spaced from the second plate. The first plate extends from a forefoot portion of the article of footwear to a heel portion of the article of footwear. The second plate extends from the forefoot portion of the article of footwear to a midfoot portion of the article of footwear. The first plate includes a first edge and the second plate includes a second edge. The first edge faces the second edge. The first edge has a first contour corresponding to a second contour of the second edge. The method further including combining the sole with an upper to form an article of footwear.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the invention, and be protected by the following claims.

For example, and in one configuration, an article of footwear is provided and includes an upper and a midsole attached to the upper and including a first surface opposing the upper and a second surface formed on an opposite side of the midsole than the first surface. The article of footwear additionally includes a first sole plate having a first reinforcement member formed from a first material that is more rigid than a material of the midsole and a second sole plate having a second reinforcement member formed from a second material that is more rigid than a material of the midsole. The second sole plate is spaced apart and separated from the first sole plate.

In one configuration, the second sole plate includes a third reinforcement member formed from a third material that is more rigid than a material of the midsole. The third reinforcement member may be spaced apart from the second reinforcement member. An elastomer may join the second reinforcement member and the third reinforcement member and may attach the second sole plate and the third sole plate to the midsole.

A channel may be formed into the elastomer in an area between the second reinforcement member and the third reinforcement member to permit relative movement between the second reinforcement member and the third reinforcement member. A groove may be formed into the midsole within the channel.

At least one cleat may extend from the second sole plate and away from at least one of the second reinforcement member and the third reinforcement member.

In one configuration, the first sole plate may include an elastomer that attaches the first reinforcement member to the midsole. A channel may separate the elastomer from the second sole plate. A groove may be formed into the midsole within the channel.

In another configuration, an article of footwear is provided and includes an upper and a midsole attached to the upper and including a first surface opposing the upper and a second surface formed on an opposite side of the midsole than the first surface. The article of footwear may additionally include a first sole plate having a first reinforcement member formed from a first material that is more rigid than a material of the midsole and attached to the midsole by a first elastomer and a second sole plate having a second reinforcement member formed from a second material that is more rigid than a material of the midsole and attached to the midsole by a second elastomer. The second sole plate is independently moveable relative to the first sole plate.

The second sole plate may include a third reinforcement member formed from a third material that is more rigid than a material of the midsole. The third reinforcement member may be spaced apart from the second reinforcement member. The second elastomer may join the second reinforcement member and the third reinforcement member and may attach the third sole plate to the midsole.

A channel may be formed into the second elastomer in an area between the second reinforcement member and the third reinforcement member to permit relative movement between the second reinforcement member and the third reinforcement member. A groove may be formed into the midsole within the channel.

At least one cleat may extend from the second sole plate and away from at least one of the second reinforcement member and the third reinforcement member.

A channel may separate the first elastomer from the second sole plate. A groove may be formed into the midsole within the channel.

At least one cleat may extend from the first sole plate and away from the first reinforcement member.

FIG. 1 illustrates an article of footwear 100, or simply article 100, including a sole plate 102 affixed to an upper 104. The upper 104 may be attached to the sole plate 102 by any known mechanism or method. For example, the upper 104 may be stitched to the sole plate 102 and/or the upper 104 may be glued to the sole plate 102. The upper 104 may be configured to receive a foot. The exemplary configuration shows a generic design for the upper. In some configurations, the upper may include another type of design. For instance, the upper 104 may be a seamless warp knit tube of mesh.

In some configurations, the article 100 includes a midsole 103. As shown in FIG. 1, the midsole may be disposed between the upper 104 and the sole plate 102. The midsole 103 may be formed of various materials. For example, the midsole 103 may be formed from a cushioning material such as an expanded rubber, foam rubber, polyurethane, and the like. In other configurations, the midsole 103 is omitted (not shown).

The sole plate 102 and the upper 104 may be made from materials known in the art for making articles of footwear. For example, the sole plate 102 may be made from elastomers, siloxanes, natural rubber, synthetic rubbers, aluminum, steel, natural leather, synthetic leather, plastics, and/or thermoplastics. In another example, the upper 104 may be made from nylon, natural leather, synthetic leather, natural rubber, and/or synthetic rubber.

A sole plate may be characterized as having various portions or regions associated with different portions or regions of a foot. The sole plate may include a forefoot region disposed proximate a wearer's forefoot. For example, as shown in FIG. 1, sole plate 102 may include a forefoot portion 10. The sole plate may include a heel region disposed proximate a wearer's heel and opposite the forefoot region. For example, sole plate 102 may include a heel portion 14. The sole plate may include a midfoot region disposed between the forefoot region and the heel region. For example, sole plate 102 may include a midfoot portion 12.

Figure 2:
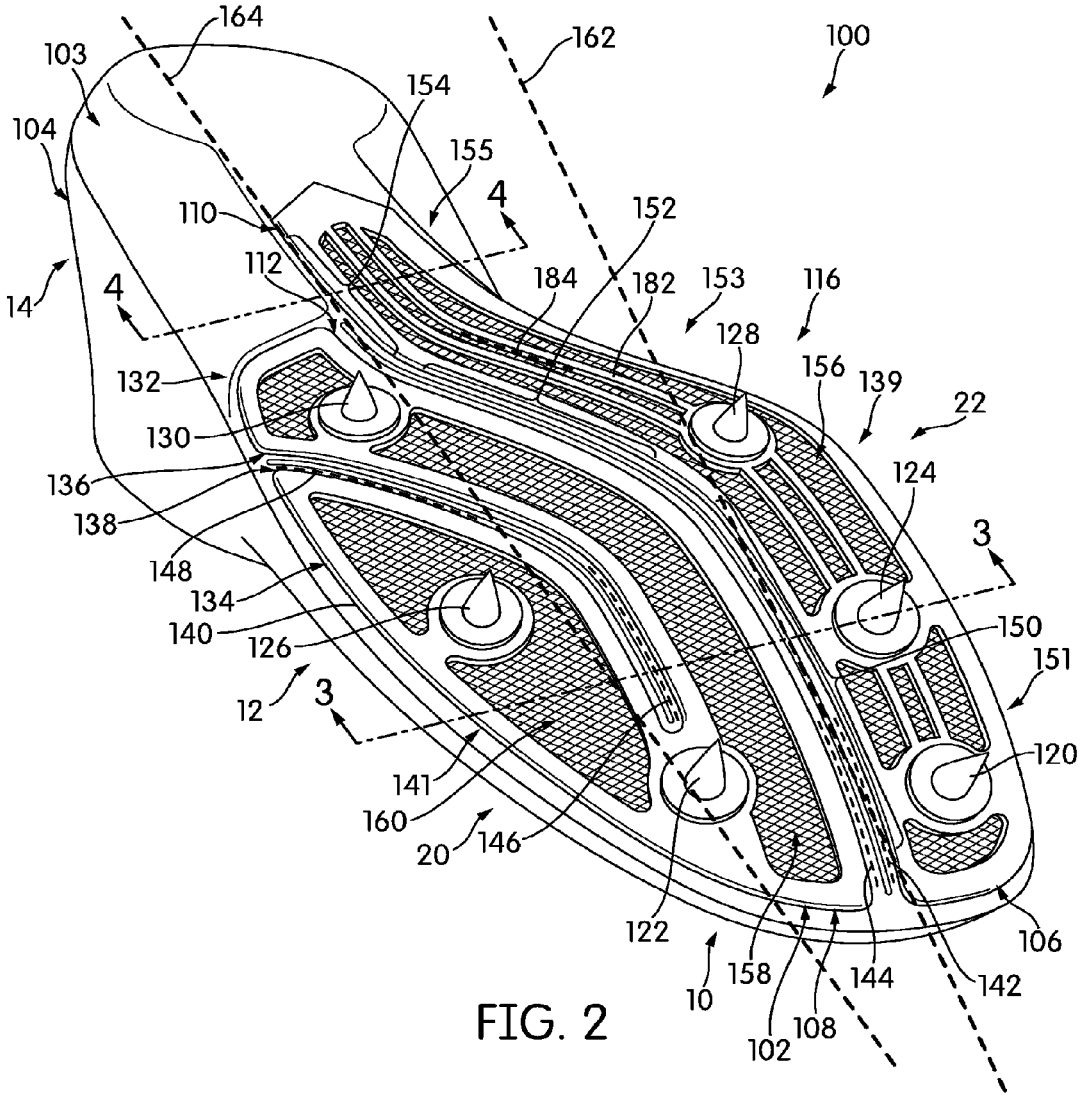
FIG. 2 is an isometric view of the sole plate of FIG. 1.

Referring now to FIG. 2, the sole plate 102 may include a medial side and a lateral side opposite to the medial side. For example, as shown, the sole plate 102 may include a medial side 22 and a lateral side 20. In one configuration, the sole plate 102 includes an exposed medial edge 139 on the medial side 22 and an exposed lateral edge 141 on the lateral side 20.

The bottom surface of the sole plate 102 may be configured to contact a playing surface. For example, the bottom surface 116 may be configured to contact grass, synthetic turf, dirt, or sand. The bottom surface of the sole plate 102 may include provisions for increasing traction with such a playing surface. For example, as shown in FIG. 2, such provisions may include cleats. As shown, for example in FIG. 2, a first cleat 120, a second cleat 122, a third cleat 124, a fourth cleat 126, a fifth cleat 128, and a sixth cleat 130 may be disposed on forefoot portion 10 of the sole plate 102. Additional cleats (not shown) may be disposed on the heel portion 14 of the sole plate 102 and/or on the midfoot portion 12 of the sole plate 102.

In some configurations, the sole plate may include cleats that extend from the bottom surface. For example, as shown in FIG. 2, the sole plate 102 may include cleats integrally formed with the sole plate 102 through molding. In another example, the sole plate 102 may be configured to receive cleats. In some configurations, the sole plate 102 may include cleat receiving members configured to receive removable cleat members (neither shown). For example, the cleat receiving members may include threaded holes and the cleats may screw into the threaded holes. In some configurations, the cleat receiving members may be raised with respect to the sole plate 102. In other configurations, the cleat receiving members may be flush with the bottom surface 116 of the sole plate 102.

The cleats 120-130 may be made from materials known in the art for making articles of footwear. For example, the cleats 120-130 may be made from elastomers, siloxanes, natural rubber, synthetic rubbers, aluminum, steel, natural leather, synthetic leather, plastics, and/or thermoplastics. In some configurations, the cleats 120-130 may be made of the same materials. In other configurations, the cleats 120-130 may be made of various materials. For example, the first cleat 120 may be made of aluminum while the second cleat 122 is made of a thermoplastic material.

The cleats 120-130 may include any shape. In some configurations, the cleats 120-130 may all have the same shape. For example, in the exemplary configuration shown in FIGS. 1-2, the first cleat 120 may have a similar or even identical shape as the sixth cleat 130. In other configurations, at least one of the cleats 120-130 may have a different shape from another cleat 120-130. In some configurations, the cleats may have a first set of identically shaped cleats and/or a second set of identically shaped cleats.

In some configurations, the cleats 120-130 may have the same height, width, and/or thickness as each other. In other configurations, the cleats 120-130 may have different heights, different widths, and/or different thicknesses from each other. In some configurations, a first set of cleats may have the same height, width, and/or thickness as each other, while a second set of cleats may have a different height, width, and/or thickness from the first set of cleats.

The cleats 120-130 may be arranged in any cleat pattern on the sole plate 102. For example, as shown in FIG. 2, the first cleat 120, the third cleat 124, and the fifth cleat 128 may be aligned with one another and adjacent to the exposed medial edge 139. Similarly, in some configurations, the second cleat 122 and the sixth cleat 130 may be aligned with one another and adjacent to the exposed lateral edge 141. Further, the fourth cleat 126 may also be substantially aligned with the second cleat 122 and the sixth cleat 130, with the fourth cleat 126 being disposed adjacent to the exposed lateral edge 141. While configurations of FIGS. 1-20 are illustrated with the same cleat pattern (arrangement), it is understood that other cleat patterns may be used with the sole plate. The arrangement of the cleats may enhance traction for a wearer during cutting, turning, stopping, accelerating, and/or backward movement.

The sole plate 102 may include components other than cleats that contact a playing surface and increase traction. In some configurations, the sole plate may include traction elements (none shown) that are smaller than cleats or studs. The traction elements on the sole plate may increase control for a wearer when maneuvering forward on a surface by engaging the surface. Additionally, traction elements may also increase the wearer's stability when making lateral movements by digging into a playing surface. In some configurations, the traction elements may be molded into the sole plate 102. In some configurations, the sole plate 102 may be configured to receive removable traction elements.

In one configuration, the sole plate 102 is segmented to provide flexibility in the lateral direction. As such, a user may have an improved feel of the playing surface during use of the article 100. For example, the segmentation of the sole plate 102 may allow the article 100 to roll in response to an impact on the lateral side. Such a rolling function may be further utilized in operations where a lateral impact onto a playing surface is common, for example, when a user is turning.

As shown in FIG. 2, the sole plate 102 may include a first sole plate 106 and a second sole plate 108. As shown, the first plate 106 is spaced apart and separated from the second plate 108. For example, as shown in FIG. 2, the first plate 106 is positioned on the sole plate 102 such that no portion of the first plate 106 contacts the second plate 108. In fact, a channel may extend between the first plate 106 and the second plate 108 to separate the first plate 106 from the second plate 108. In some configurations, the first plate 106 is spaced from the second plate 108 such that the first plate 106 contacts the second plate 108 while in a forced position but not during a rest position. Such a forced position may occur, for example, during a turning operation. In other configurations, the first plate 106 is further spaced from the second plate 108 such that the first plate 106 does not contact the second plate 108 while in a forced position.

In some instances, flexibility in the lateral direction compared to the longitudinal direction is desired. In such cases, the first plate 106 may include a first edge 110 and the second plate 108 may include a second edge 112. In some configurations, the first edge 110 and the second edge 112 are spaced apart from each other, as defined by the channel descried above. Therefore, the first plate 106 and the second plate 108 may, at least partially, move relative to each other. As such, the first edge 110 and the second edge 112 may allow flexing of the sole plate 102 in the lateral direction by permitting independent relative movement between the first sole plate 106 and the second sole plate 108.

In some cases, even further flexibility in the lateral direction compared to the longitudinal direction is desired. In such cases, the second plate 108 may further include a central region 132 and a lateral region 134 that are separated by a channel that extends into the second plate 108. For example, as shown in FIG. 2, the central region 132 includes the second edge 112 and further includes a third edge 136. Additionally, FIG. 2 shows that the lateral region 134 includes a fourth edge 138 and a fifth edge 140. As such, the first edge 110, the second edge 112, the third edge 136, and the fourth edge 138 allow the first plate 106, the central region 132, and the lateral region 134 to flex in the lateral direction. Namely, the central region 132 and the lateral region 134 are allowed to at least partially move relative to one another and relative to the first plate 106 to enhance the flexibility of the sole plate 102.

It may be desirable to further improve flexibility in the lateral direction, for example, in order to improve a user's comfort during turns. In one example, the first plate 106 includes a forefoot region 151, a transition region 153, and a midfoot region 155. For instance, the transition region 153 may extend between the forefoot region 151 and the midfoot region 155. Additionally, the midfoot region 155 may extend from an exposed lateral edge 141 of the sole plate 102 (e.g., first edge 110) to an exposed medial edge 139 of the sole plate 102. Moreover, in some configurations, the forefoot region 151 may extend from the first edge 110 to the exposed medial edge 139 of the sole plate 102. Further, in one configuration, the transition region 153 may extend from first edge 110 to the exposed medial edge 139 of the sole plate 102. In some configurations, the second plate 108 may extend from the exposed lateral edge 141 of the sole plate 102 to the second edge 112. Accordingly, the first plate 106 may have a shape to improve a user's comfort during turns by having an orientation angled between the medial axis 162 and the lateral axis 164.

In some cases, the article 100 is provided with even further flexibility in the lateral direction compared to the longitudinal direction. For instance, in such configurations, the first edge 110 has a first contour 142. As shown in FIG. 2, the first edge 110 includes a forefoot segment 150, a transition segment 152, and a midfoot segment 154. As such, the first edge 110 has a first contour 142. In some configurations the second edge 112 has a second contour 144 that substantially corresponds to the first contour 142. Similarly, in some configurations the third edge 136 has a third contour 146 that substantially corresponds to the first contour 142. Moreover, in some configurations the fourth edge 138 has a fourth contour 148 that substantially corresponds to the first contour 142. As such, the first edge 110, the second edge 112, the third edge 136, and the fourth edge 138 allow the first plate 106, the central region 132, and the lateral region 134 to flex in the lateral direction. For example, the first contour 142 may have an orientation angled between the medial axis 162 and the lateral axis 164 to improve a user's comfort during turns.

As used herein, a contour corresponds to another contour when shapes of the contours are similar. For example, the first contour 142 has a curve and/or or shape having a side extending along the medial axis 162, extending from the medial axis 162 at an angle, and extending along the lateral axis 164. Accordingly, in the example, the second contour 144 may correspond to the first contour 142 because the second contour 144 has a curve and/or shape equivalent to the first contour 142. In some configurations, contours having different lengths may correspond. For example, the first contour 142 includes a portion extending a long distance along the lateral axis 164 and the second contour 144 has a portion extending a short distance along an axis parallel to the medial axis 162.

In one configuration, the first plate extends from a forefoot portion of the article 100 to a heel portion of the article. For example, as shown in FIG. 2, the first plate 106 has a forefoot region 151 disposed in the forefoot portion 10 that extends towards the heel portion 14. Moreover, the first plate 106 further includes a transition region 153 that extends through a midfoot portion 12. Further, the first plate 106 includes a midfoot region 155 that extends into the heel portion 14.

In one configuration, the second plate 108 extends from a forefoot portion of the article 100 to a midfoot portion of the article 100. For example, as shown in FIG. 2, the second plate 108 has a central region 132 in the forefoot portion 10 that extends into the midfoot portion 12. Moreover, the second plate 108 further includes a lateral region 134 that extends in the forefoot portion 10. In some configurations, the lateral region 134 extends into the midfoot portion 12.

In some cases, the forefoot segment 150 extends along a medial axis extending in a substantially longitudinal direction along the medial side 22 of the article 100. For example, as shown in FIG. 2, the forefoot region 151 extends along medial axis 162.

In some cases, the midfoot segment 154 extends along a lateral axis extending in a substantially longitudinal direction along the lateral side 20 of the article 100. For example, as shown in FIG. 2, the midfoot region 155 extends along the lateral axis 164.

In some configurations, the first cleat 120, the third cleat 124, and the fifth cleat 128 are a first set of cleats disposed under a first rigid member or reinforcement member 156 of the first plate 106. For example, the first cleat 120, the third cleat 124, and the fifth cleat 128 may be vertically separated from a lower surface of the first rigid member 156. Similarly, in some configurations, the second cleat 122, the fourth cleat 126, and the sixth cleat 130 are a second set of cleats disposed under a second rigid member or reinforcement member 158 and a third rigid member or reinforcement member 160 of the second plate 108. For example, the second cleat 122, the fourth cleat 126, and the sixth cleat 130 may be vertically separated from a lower surface of the second rigid member 158 and the third rigid member 160.

Figure 3:
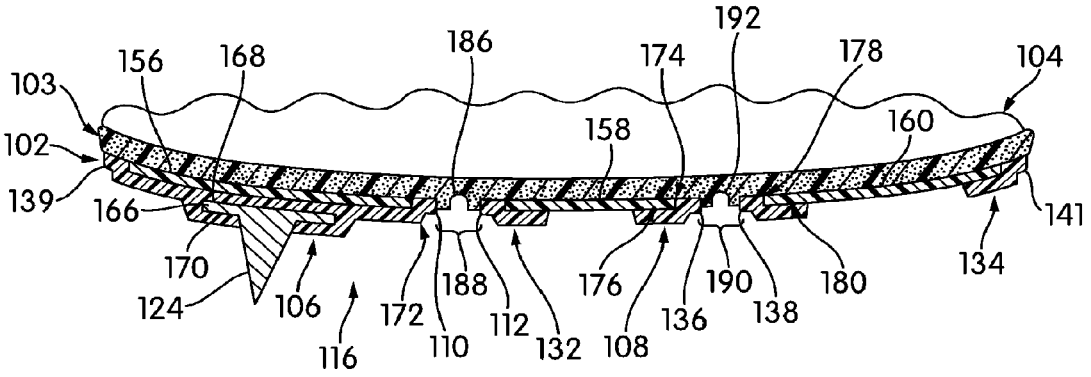
FIG. 3 is a cross-sectional view of the sole plate of FIG. 1 taken along line 3-3 of FIG. 1.

FIG. 3 illustrates a ground engagement surface of the first plate 106 and the second plate 108. In one configuration, an elastomer may be used to attach the first set of cleats to the first rigid member 156. For example, as shown, the third cleat 124 includes a flange 166 having an upper surface 168 and a lower surface 170. Moreover, an elastomer 172 is formed between the first rigid member 156 and the upper surface 168 and the elastomer 172 is formed between the lower surface 170 and a bottom surface 116 of the first plate 106. The elastomer 172 may be formed of various materials. For example, the elastomer 172 may be a thermoplastic rubber, a thermoplastic elastomer (TPE) such as polyether block amide (PEBAX), and the like. In some configurations, the elastomer 172 may be transparent. In other configurations, the elastomer 172 is opaque. In some instances, the elastomer 172 has a portion combined with a coloring additive. For example, a transparent elastomer 172 may be combined with a blue color, resulting in the elastomer 172 having a blue appearance.

Similarly, in one configuration, the first cleat 120, the second cleat 122, the fourth cleat 126, the fifth cleat 128, and the sixth cleat 130 are attached similarly to the third cleat 124. For example, the fourth cleat 126 may be attached to a third rigid member 160 using the elastomer 172. Moreover, in another example, the sixth cleat 130 may be attached to the second rigid member 158 using the elastomer 172. In other configurations, cleats are attached differently. For example, the first cleat 120 may include a receiving member configured to receive a cleat member (neither shown).

In one configuration, the elastomer 172 attaches the first rigid member 156 to the midsole 103 and, thus, forms the first sole plate 106. Similarly, the elastomer 172 attaches the second rigid member 158 and the third rigid member 160 to one another and to the midsole 103 and, thus, forms the second sole plate 108. For example, as shown in FIG. 3, the elastomer 172 is formed on side surfaces (e.g., side surface 174) of the second rigid member 158 and part of a lower surface 176 of the second rigid member 158. In another example, as shown in FIG. 3, the elastomer 172 is formed on side surfaces (e.g., side surface 178) of the third rigid member 160 and part of a lower surface 180 of the third rigid member 160.

In some instances, a portion 188 of the midsole 103 extending between the first edge 110 and the second edge 112 may be exposed. For instance, as shown in FIG. 3, the portion 188 is exposed to allow the first plate 106 and the second plate 108 to elastically move relative to each other. Moreover, the portion 188 may include a groove 186. In some configurations the groove 186 has a shape corresponding to a shape of the portion 188 of the midsole 103. For instance, a shape corresponding to the first contour 142 (as seen in FIG. 2) and/or to the channel extending between the first sole plate 106 and the second sole plate 108.

In some instances, a portion 190 of the midsole 103 extending between the third edge 136 and the fourth edge 138 may be exposed. For instance, as shown in FIG. 3, the portion 190 is exposed to allow the central region 132 and the lateral region 134 to elastically move relative to each other. Moreover, the portion 190 may include a groove 192. In some configurations the groove 192 has a shape corresponding to a shape of the portion 190 of the midsole 103. For instance, a shape corresponding to the first contour 142 (as seen in FIG. 2) and/or to the channel extending into the second sole plate 108 and between the second rigid member 158 and the third rigid member 160.

Figure 4:
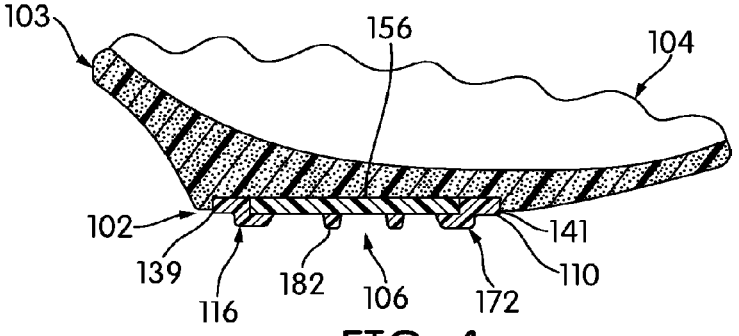
FIG. 4 is a cross-sectional view of the sole plate of FIG. 1 taken along line 4-4 of FIG. 1.

FIG. 4 illustrates a ground engagement surface of the first plate 106. In some instances, further energy storage in the sole plate 102 may be provided by the sole plate 102. For example, as shown in FIGS. 2 and 4, a rib 182 is formed on the bottom surface 116 of sole plate 102. In one configuration, the rib 182 extends from an outer surface of the first rigid member 156. In some configurations, the rib 182 may be formed of the elastomer. For example, as shown in FIG. 4, the rib 182 may be formed of the elastomer 172. As such, the rib 182 may provide further energy storage in the sole plate 102 while allowing lateral flexibility. In some configurations, the sole plate 102 includes additional ribs that are similar to rib 182. For example, FIGS. 2 and 4 illustrate an additional rib corresponding to rib 182.

In some configurations, the rib 182 has a rib contour to allow additional lateral flexibility. For example, as shown in FIG. 2, the rib 182 has a rib contour 184 corresponding to a shape of the first plate 106. As such, the rib 182 and the first plate 106 may allow the first plate 106 and rib 182 to flex in the lateral direction.

Figure 5:
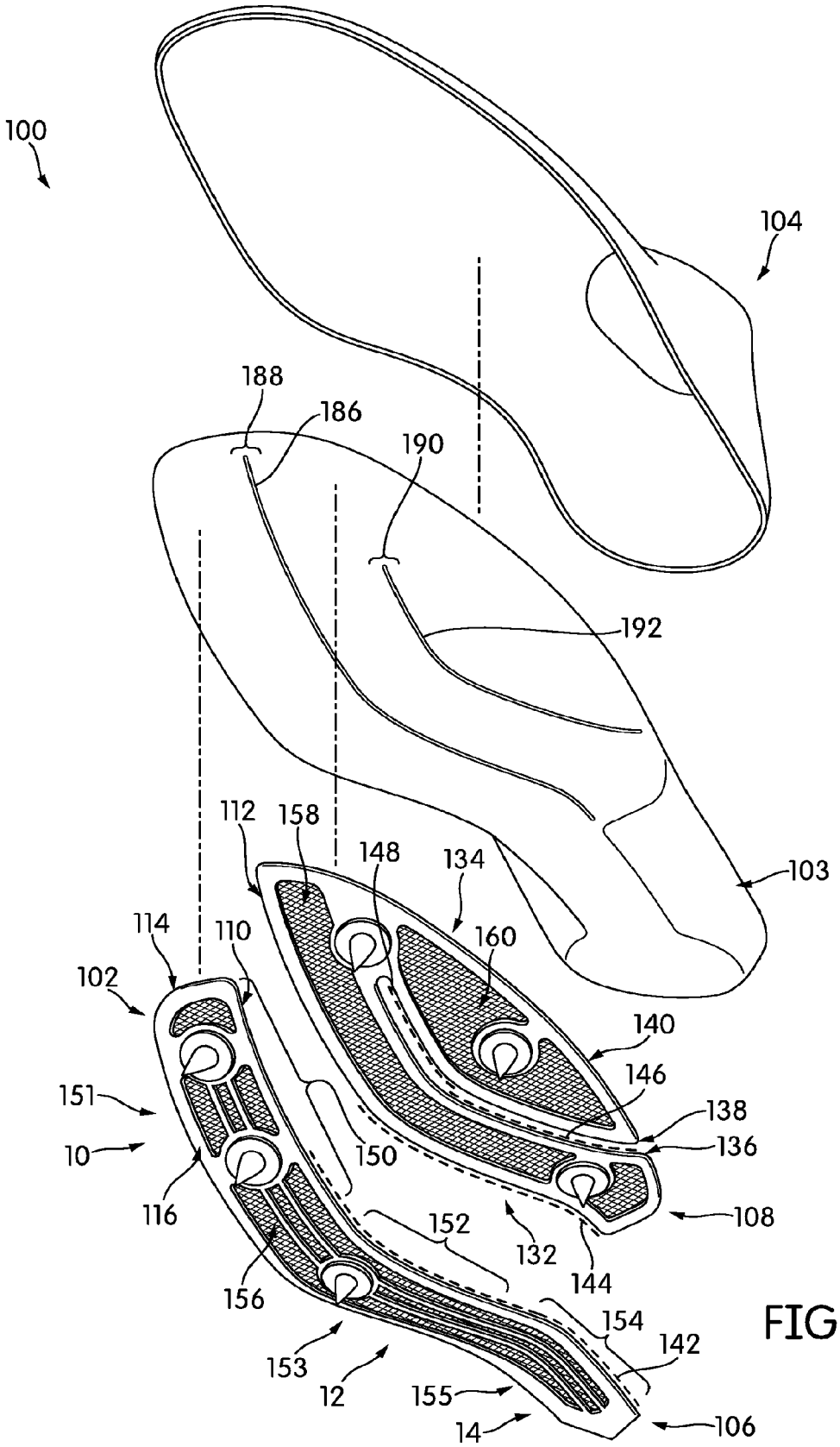
FIG. 5 is an exploded view of the sole plate of FIG. 1.
Figure 6:
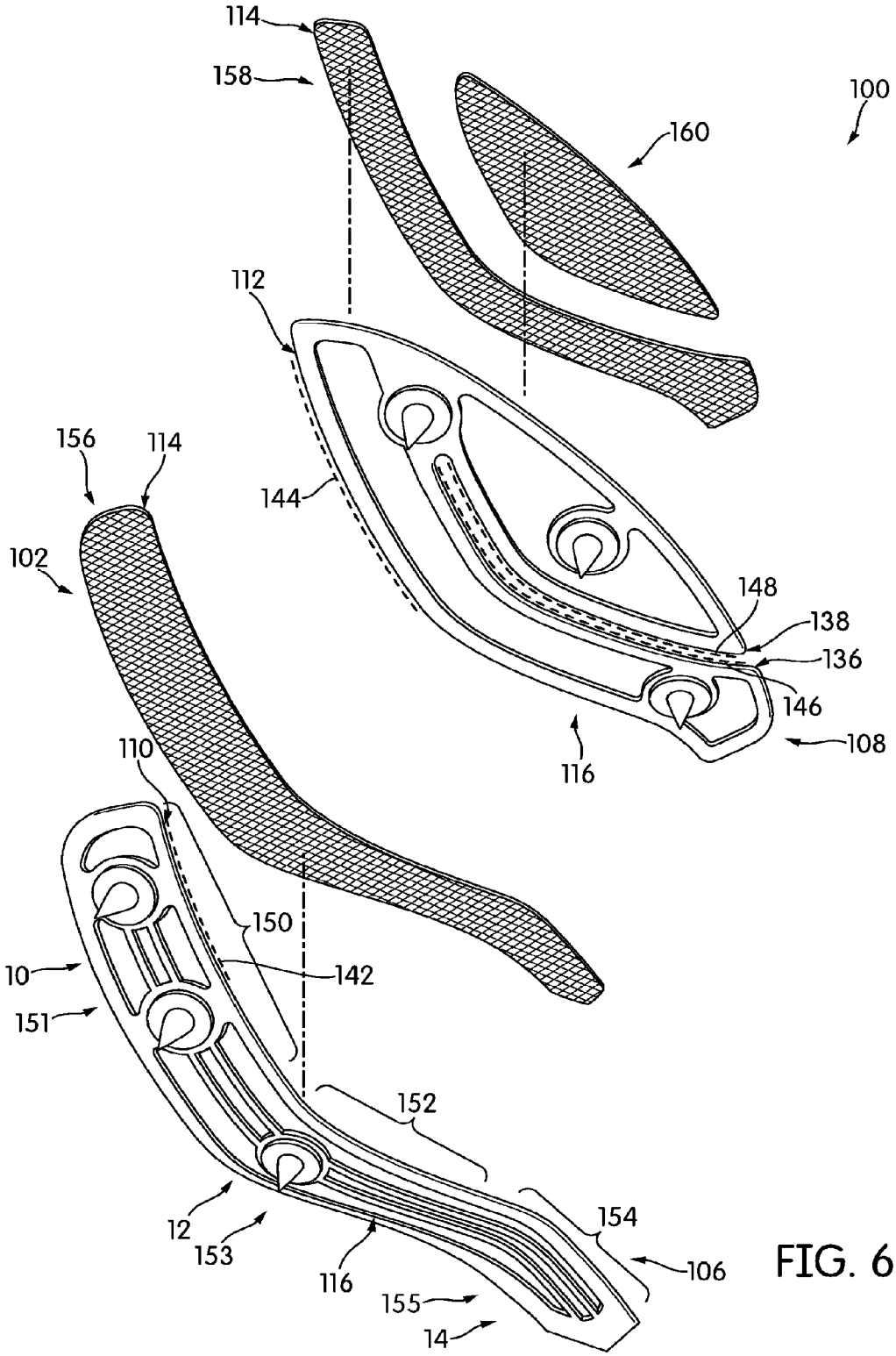
FIG. 6 is an exploded view of the sole plate of FIG. 1.

FIGS. 5 and 6 illustrate exploded views of the article 100 as shown in FIGS. 1-4, according to exemplary configurations. As shown in FIG. 5, the sole plate 102 may include a top surface 114 and a bottom surface 116. The sole plate 102 may be configured to be attached to the upper 104. In some configurations, the sole plate 102 may also be attached to a midsole (e.g., 103) or an insole of an article of footwear (e.g., article 100). In such configurations, the top surface 114 may contact the midsole 103 and/or the upper 104.

As illustrated in FIGS. 5 and 6, some configurations may include the first rigid member 156, the second rigid member 158, and the third rigid member 160 that are disposed on the bottom surface of the sole plate 102. In some configurations, the first rigid member 156, the second rigid member 158, and/or the third rigid member 160 may be formed of a rigid material having a higher rigidity than a material of the midsole 103. For example, the first rigid member 156, the second rigid member 158, and/or the third rigid member 160 may be formed of carbon fiber. In other examples, the first rigid member 156 is made of a rigid material different than the second rigid member 158 and/or the first rigid member 156 is made of a rigid material different than the third rigid member 160. Because the rigid members 156, 158, 160 are formed from a material having a higher rigidity than a material of the midsole 103, the resulting first sole plate 106 and second sole plate 108 include a higher rigidity than the midsole 103. While the plates 106, 108 provide the midsole 103 with rigidity, the plates 106, 108 also provide the midsole 103 with a degree of flexibility due to separation between the plates 106 and 108 and, further, due to the channel extending into the second sole plate 108 between the rigid members 158, 160.

In one configuration, the first rigid member 156, the second rigid member 158, and/or the third rigid member 160 may use one or more features of Auger et al. (U.S. Pat. No. 7,832,117) the entire disclosure of which is incorporated herein by reference. In some configurations, one or more methods of Auger et al. may be used to construct the first rigid member 156, the second rigid member 158, and/or the third rigid member 160.

As previously noted, the rigid material may include carbon fiber, as well as other materials. In one configuration, the rigid material includes a woven fabric such as a carbon fiber, nylon fiber, cotton fiber, textile, elastomer fiber, animal fiber, and the like. In some configurations, the rigid material is a substance having a high Young's modulus. For example, a high Young's modulus may be greater than 100 gigapascal (GPa), greater than 150 GPa, greater than 180 GPa, greater than 200 GPa, etc. Examples of rigid material having a high Young's modulus may include, for instance, copper, brass, bronze, steel, silicon carbide, tungsten carbide, and a single-walled carbon nanotube, as well as other materials. The rigid material can comprise carbon fiber. The rigid material can consist essentially of carbon fiber.

In some cases, incorporating rigid material into a sole plate 102 restricts flexing of the article 100 from a medial side to lateral side and from a lateral side to a medial side. Such flexing allows the article of footwear 100 to have improved traction by providing additional contact to a playing surface. Moreover, such flexing allows for a more natural feel to a contacting of the playing surface. Accordingly, in some configurations, the article of footwear 100 may include at least one plate 106 incorporating rigid material that is separated from another plate 108 incorporating a rigid material. For example, as shown in FIGS. 5 and 6, the first plate 106 includes a first rigid member 156 and the second plate includes a second rigid member 158 and a third rigid member 160. As Illustrated in FIGS. 5 and 6, the first rigid member 156 may extend from the forefoot portion 10 to the heel portion 14. Similarly, the second rigid member 158 may extend from the forefoot portion 10 to the midfoot portion 12 and the third rigid member 160 may extend from the forefoot portion 10 to the midfoot portion 12. As shown in FIGS. 5 and 6, the second rigid member 158 and the third rigid member 160 are separate pieces of rigid material. In other configurations, the second rigid member 158 and the third rigid member 160 are monolithic (not shown).

As shown in FIGS. 5 and 6, the first rigid member 156 extends along the first contour 142 and the first rigid member 156 maintains a substantially constant first distance from the first edge 110. Likewise, the second rigid member 158 extends along the second contour 144 and the second rigid member 158 maintains a substantially constant second distance from the second edge 112. Moreover, the third rigid member 160 extends along the fourth contour 148 and the third rigid member 160 maintains a substantially constant third distance from the fourth edge 138. Additionally, in some configurations, the second rigid member 158 extends along the third contour 146 and the second rigid member 158 maintains a substantially constant fourth distance from the third edge 136. In some configurations, the first distance, second distance, third distance, and fourth distance are identical. In other configurations, one or more of the first distance, the second distance, the third distance, and the fourth distance are different.

In some configurations, "substantially constant" distance refers to a distance between two objects at a first point and a second point that are substantially equivalent. For example, as shown in FIGS. 5 and 6, the forefoot segment 150 is separated from the first rigid member 156 by a distance substantially equivalent to a distance between the transition segment 152 and the first rigid member 156. Similarly, the transition segment 152 is separated from the first rigid member 156 by a distance substantially equivalent to a distance between the midfoot segment 154 and the first rigid member 156. As used herein, substantially equivalent may refer to distances within various tolerance levels of one another, for example, less than one percent, less than five percent, less than ten percent, and less than twenty percent.

FIGS. 7-16 illustrate an article of footwear during an operation. Specifically, FIGS. 7-16 illustrate various configurations of an article of footwear undergoing bending due to the features of the sole plate 102 described above. For example, as shown in FIGS. 7-16, the article of footwear is the article 100.

Figure 7:
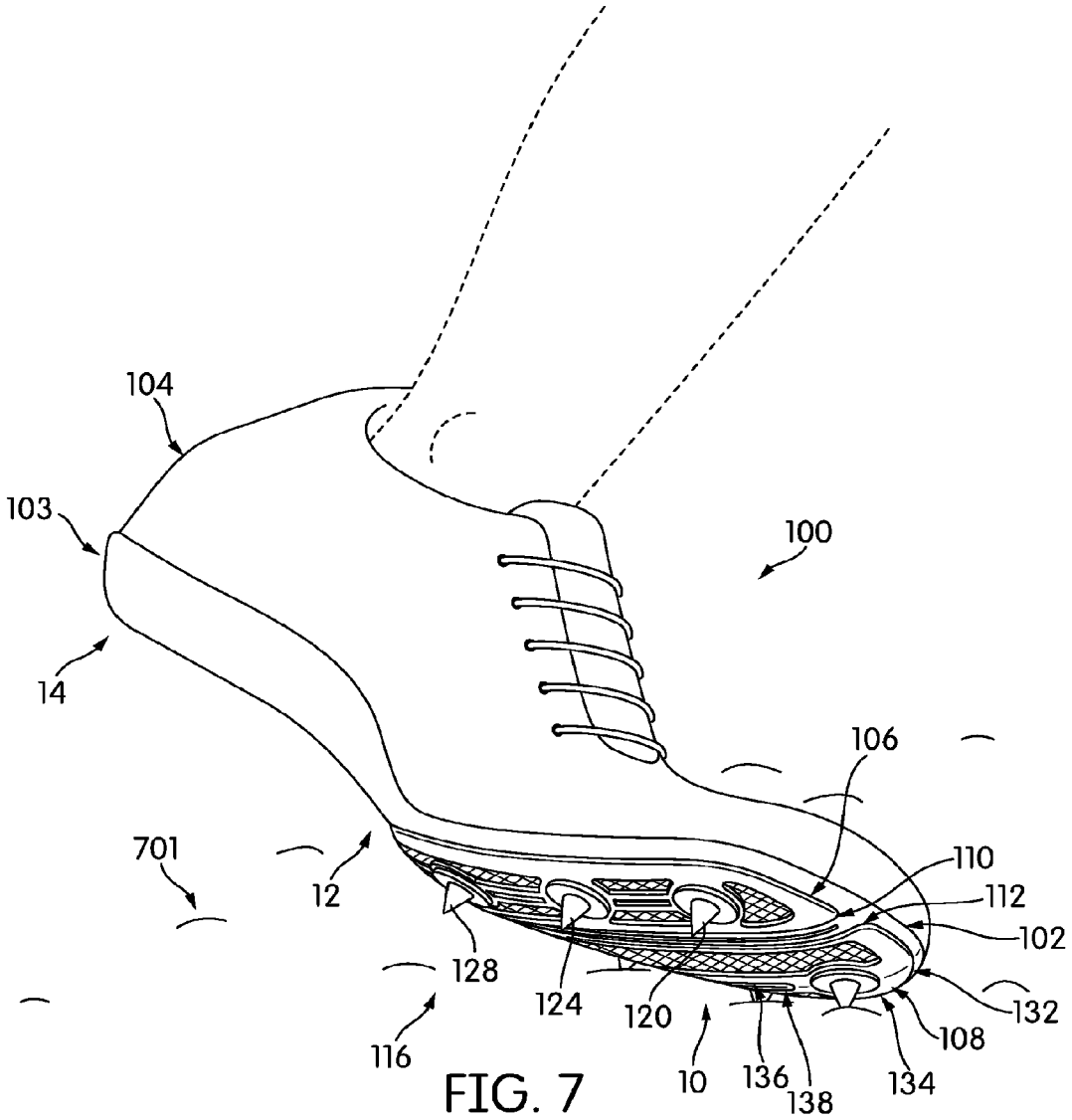
FIG. 7 is an isometric view of the article of footwear of FIG. 1 during a first flexing of the sole plate.
Figure 8:
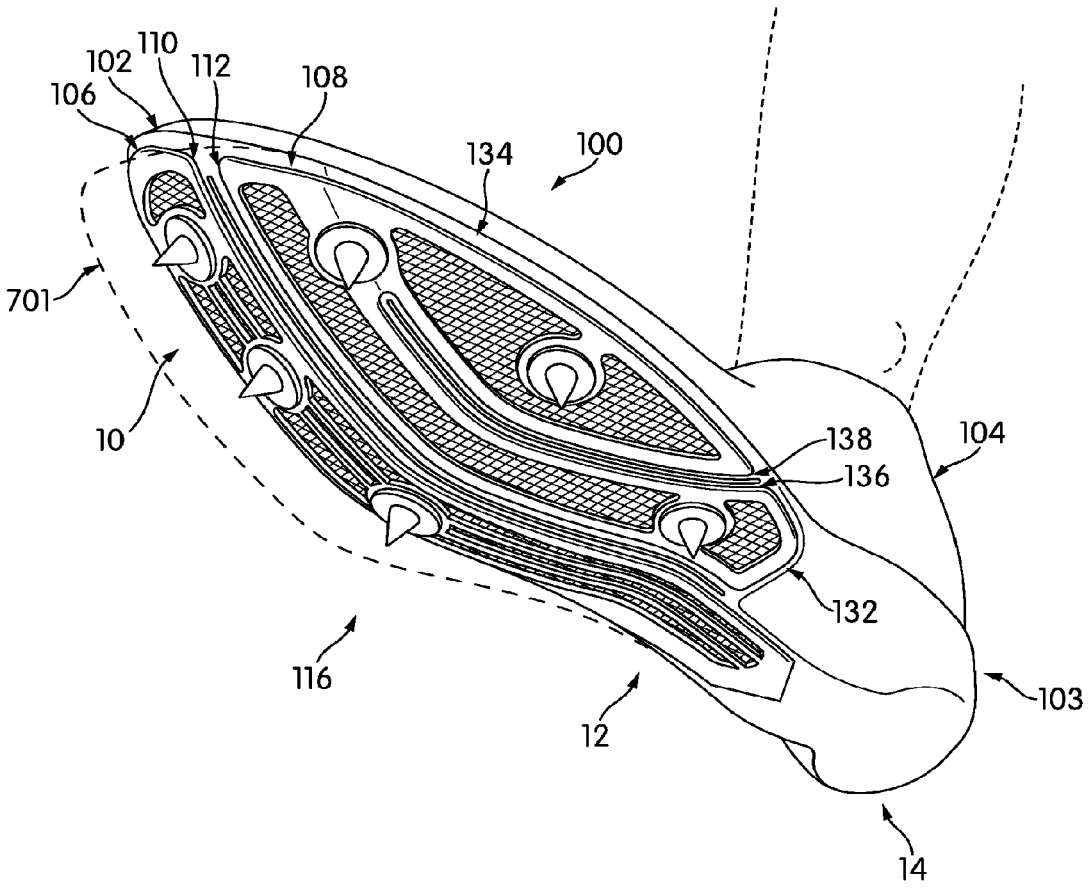
FIG. 8 is a bottom view of the article of footwear of FIG. 1 during a first flexing of the sole plate.

As shown in FIGS. 7-8, a user contacts the bottom surface 116 of the sole plate 102 with a playing surface 701. As shown, the bottom surface 116 impacts the playing surface 701 in the forefoot portion 10 of the lateral region 134 of the second plate 108. As illustrated in FIGS. 7-8, due to the impact, the sole plate 102 may begin to flex along the third edge 136 of the central region 132 and the fourth edge 138 of the lateral region 134. This flexing may allow a more natural feel to a user, as the article 100 allows the user to feel a shape of the playing surface 701.

Figure 9:
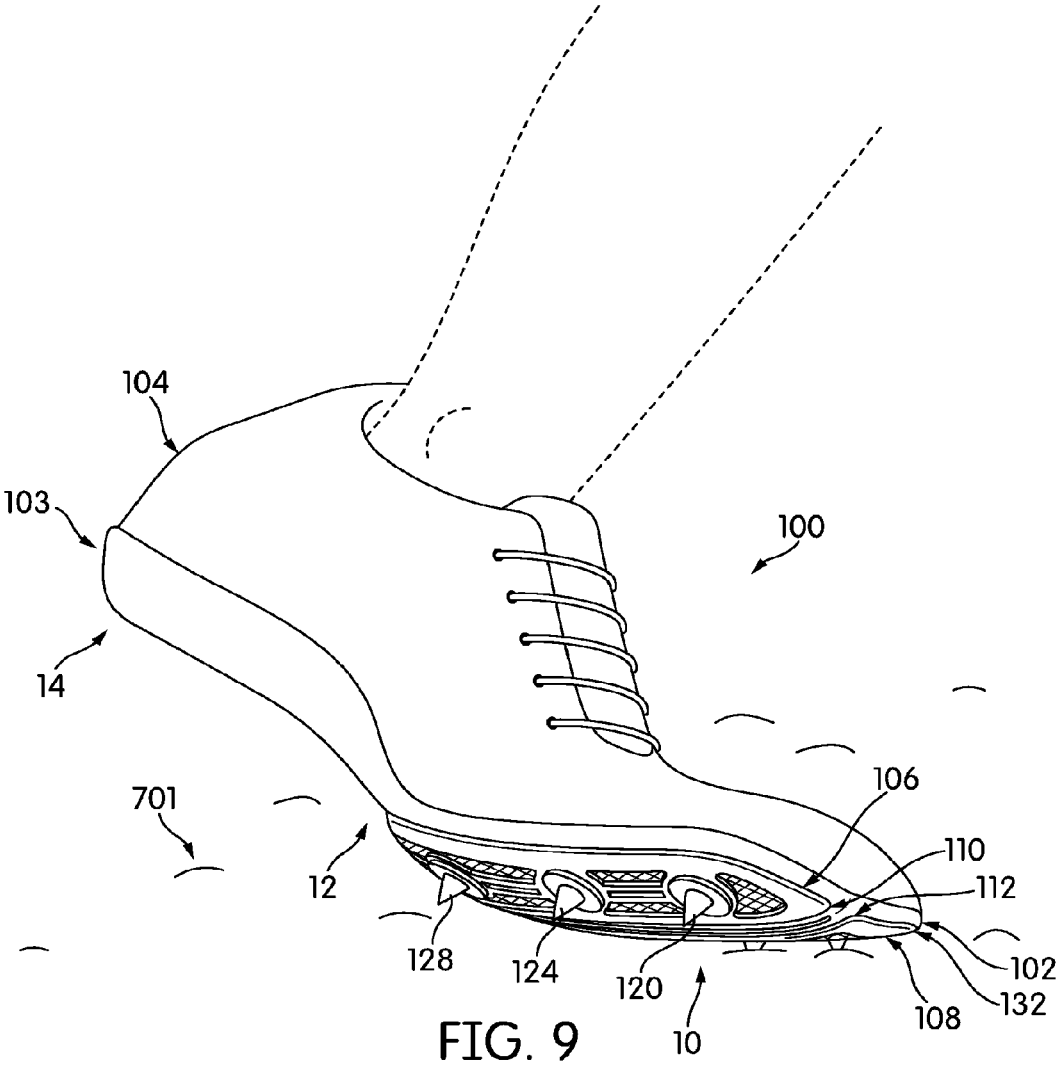
FIG. 9 is an isometric view of the article of footwear of FIG. 1 during a second flexing of the sole plate.
Figure 10:
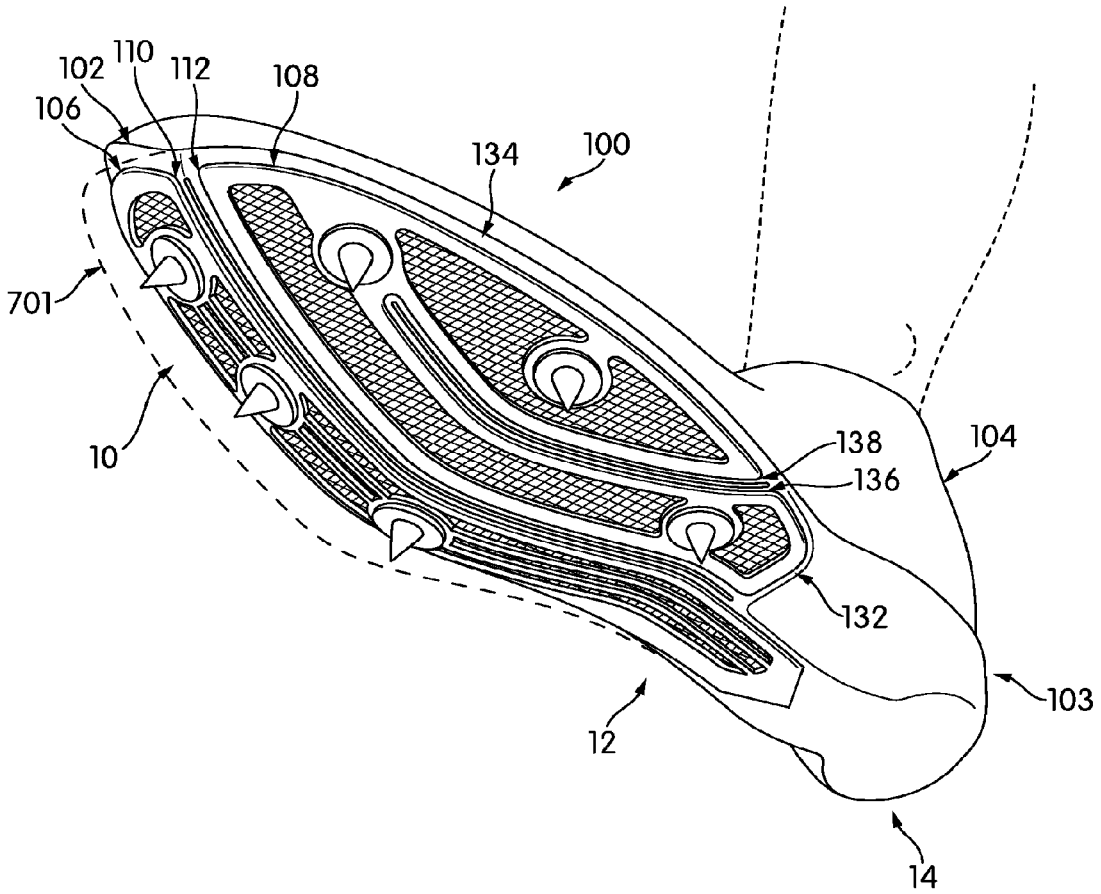
FIG. 10 is a bottom view of the article of footwear of FIG. 1 during a second flexing of the sole plate.

As shown in FIGS. 9-10, the impact further causes the sole plate 102 to flex along the first edge 110 of the first plate 106 and the second edge 112 of the central region 132. This flexing allows an even further natural feel to a user, as the article 100 allows the user to feel a shape of the playing surface 701.

Figure 11:
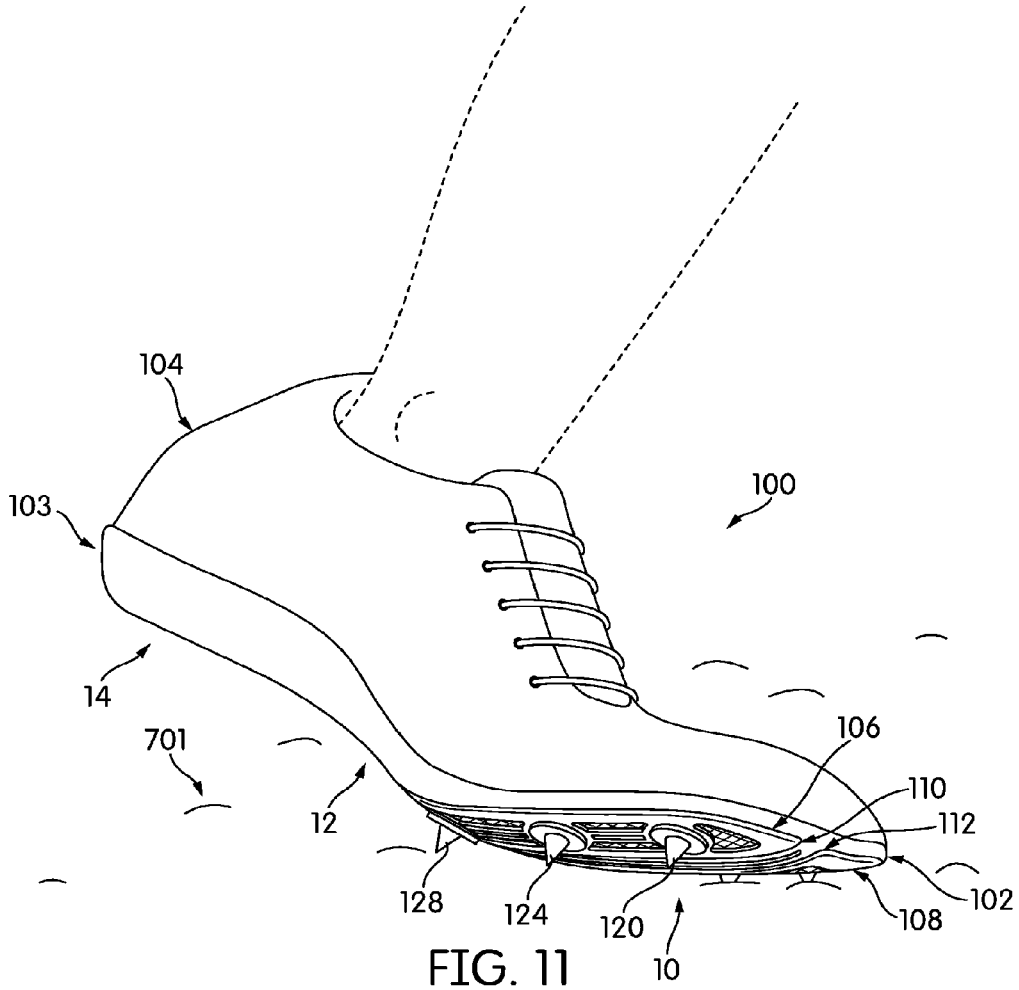
FIG. 11 is an isometric view of the article of footwear of FIG. 1 after a second flexing of the sole plate.
Figure 12:
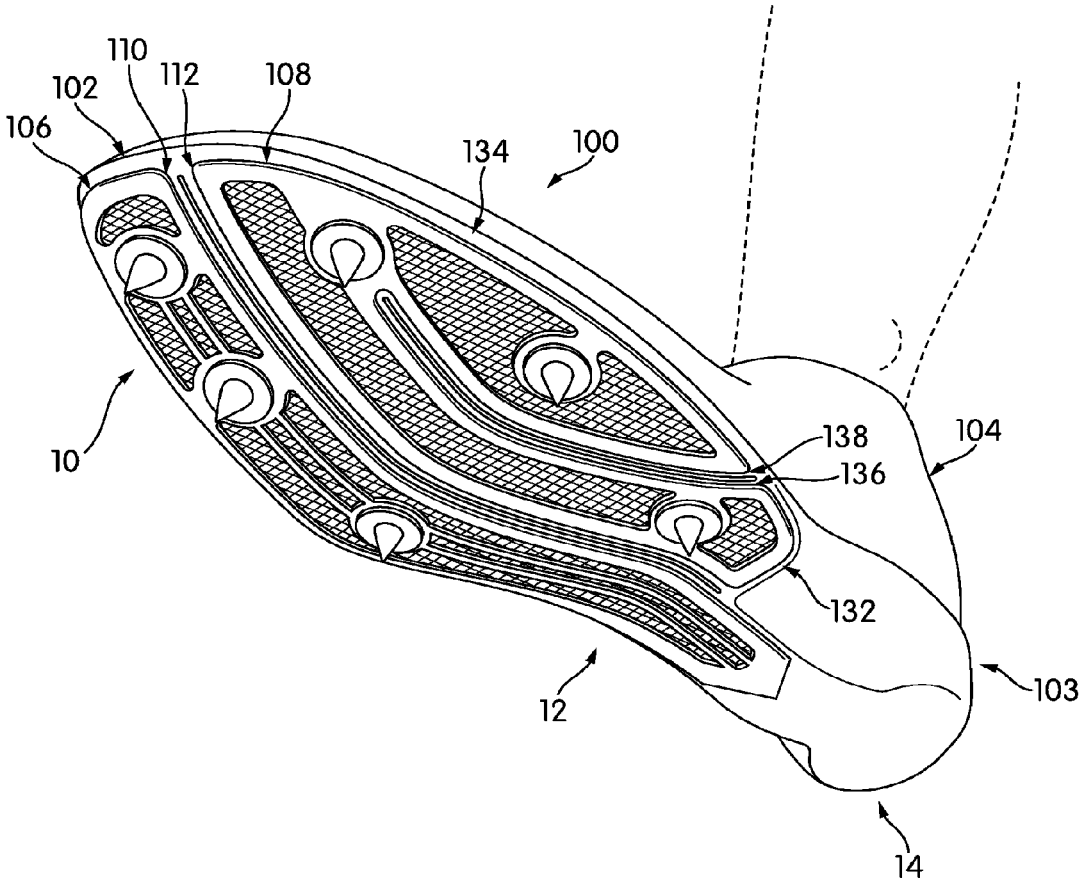
FIG. 12 is a bottom view of the article of footwear of FIG. 1 after a second flexing of the sole plate.

As shown in FIGS. 11-12, the sole plate 102 returns to a rest shape and the user begins or continues to move the heel portion 14 downward towards the playing surface 701. As shown, the rest shape is substantially planar. In other configurations, the rest shape may be concave or convex.

Figure 13:
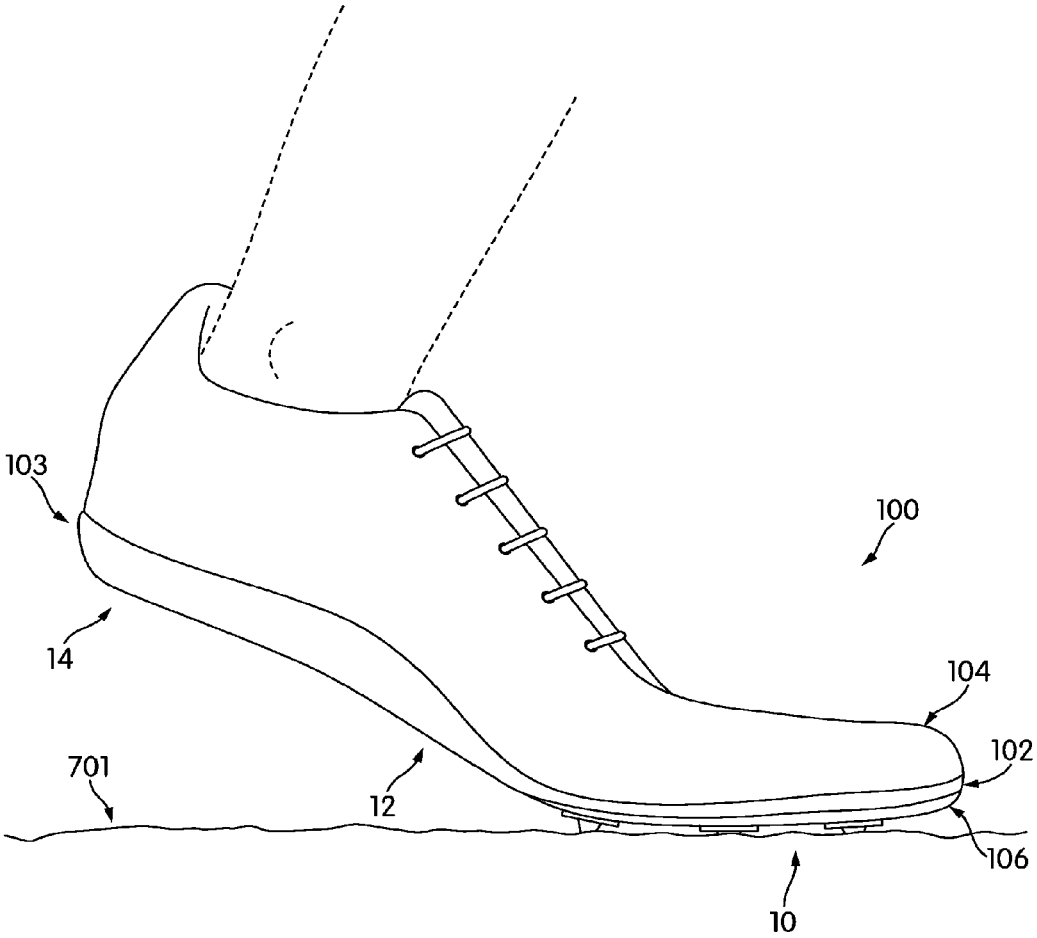
FIG. 13 is a side view of the article of footwear of FIG. 1 after a flattening of the sole plate.
Figure 14:
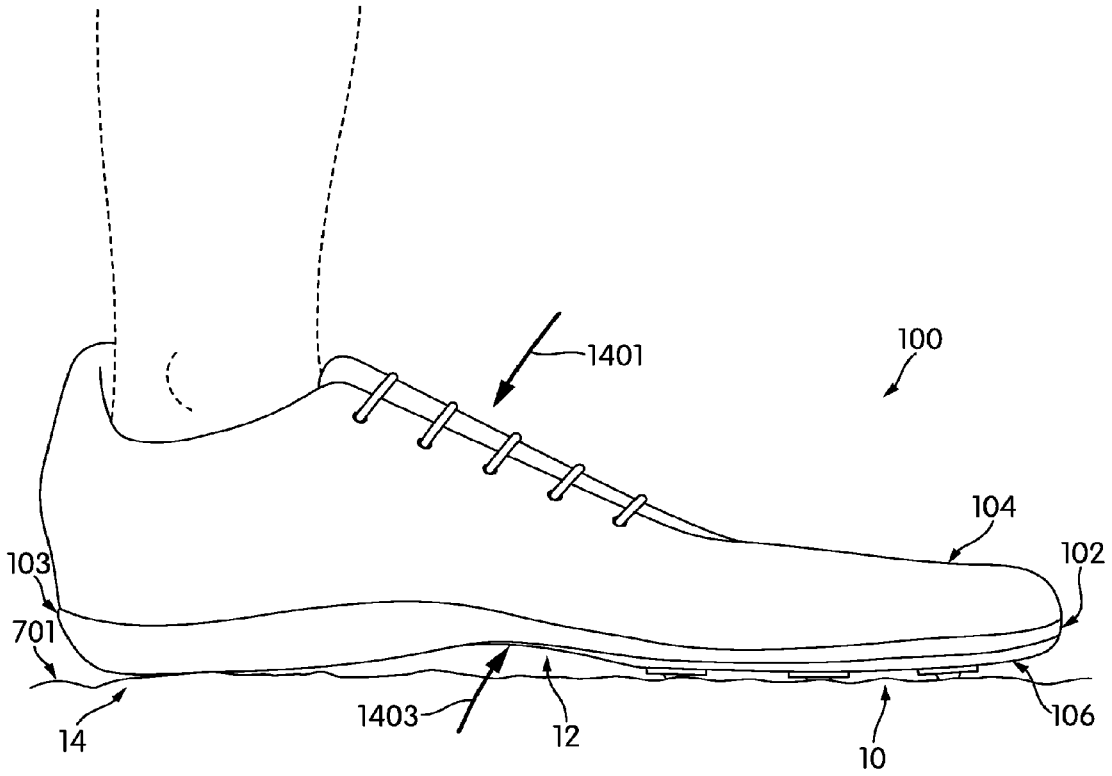
FIG. 14 is a side view of the article of footwear of FIG. 1 after storing energy into the sole plate.
Figure 15:
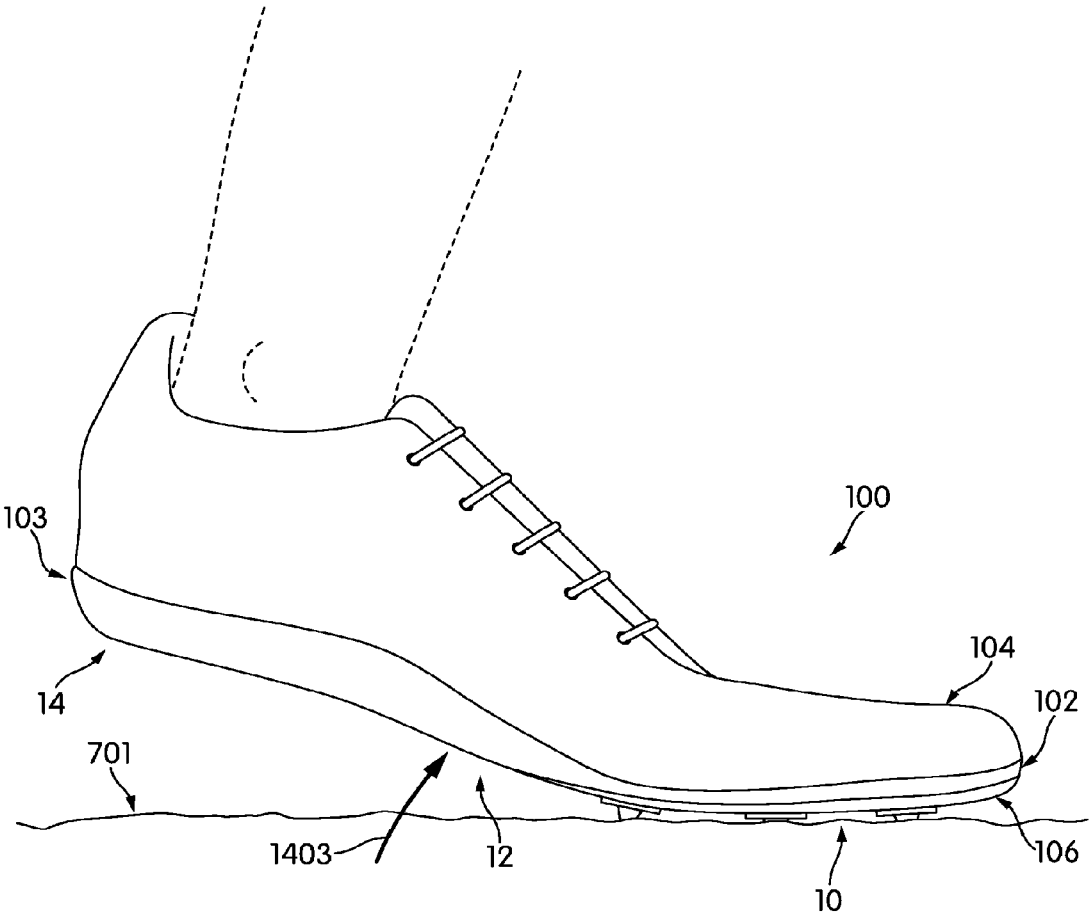
FIG. 15 is a side view of the article of footwear of FIG. 1 during releasing of the energy stored in the sole plate.
Figure 16:
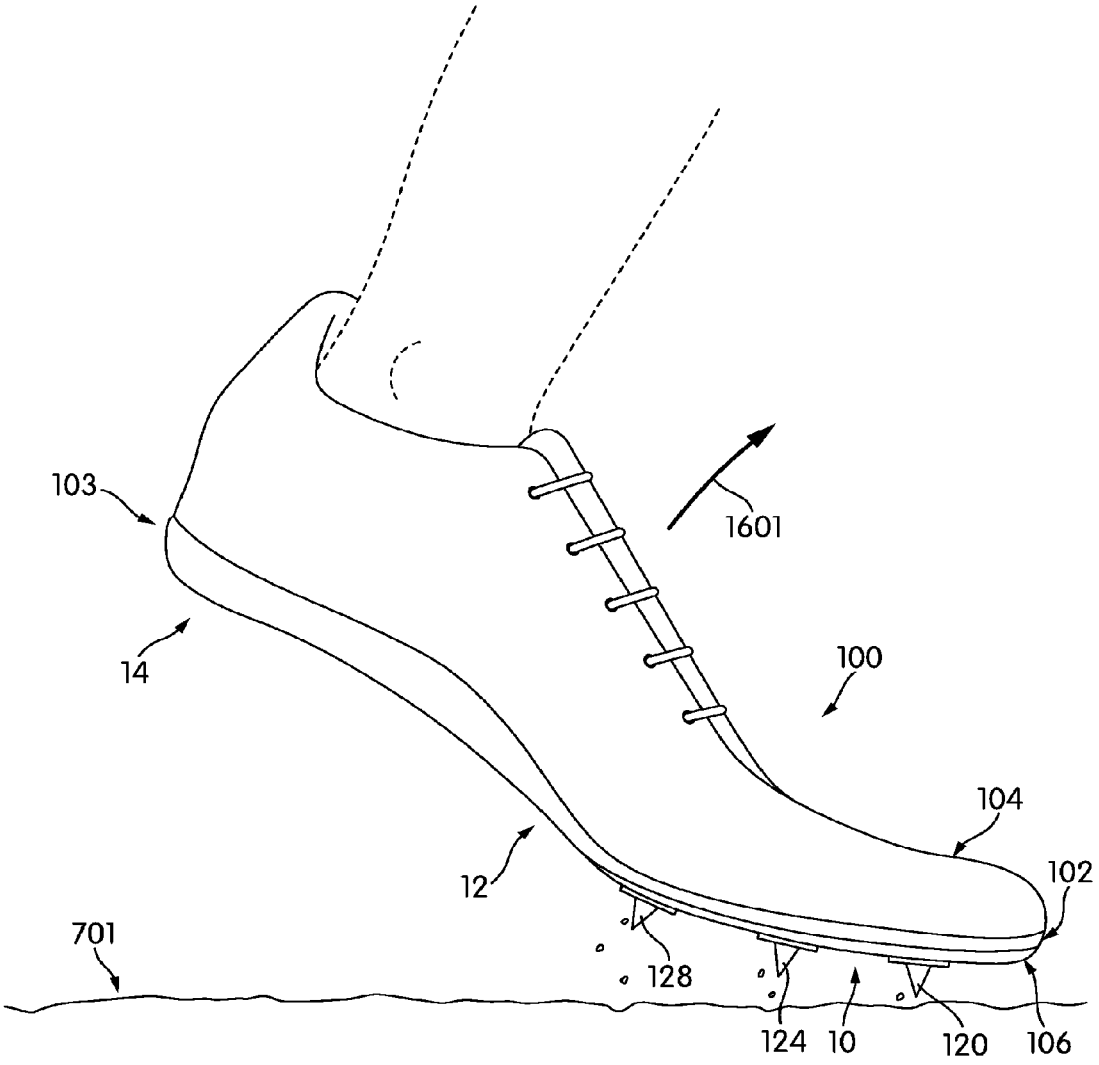
FIG. 16 is a side view of the article of footwear of FIG. 1 after releasing energy stored in the sole plate.

FIGS. 13-14, show a user forcing the heel portion 14 downward onto the playing surface 701. As shown in FIG. 14, downward movement 1401 of the heel portion 14 causes a bending of the sole plate 102. As such, the sole plate 102 may absorb a substantial amount of energy in resisting the bending action. Accordingly, as shown in FIG. 14, the sole plate 102 generates a return force 1403 to move the heel portion 14 upward from the playing surface 701. As shown in FIG. 15, the heel portion 14 is moved upward prior to the user lifting the article 100 away from playing surface 701. As shown in FIG. 16, once the sole plate 102 releases the return force 1403, the sole plate 102 returns to its original shape, and the user continues operation by lifting 1601 the article 100 from the playing surface 701.

Figure 17:
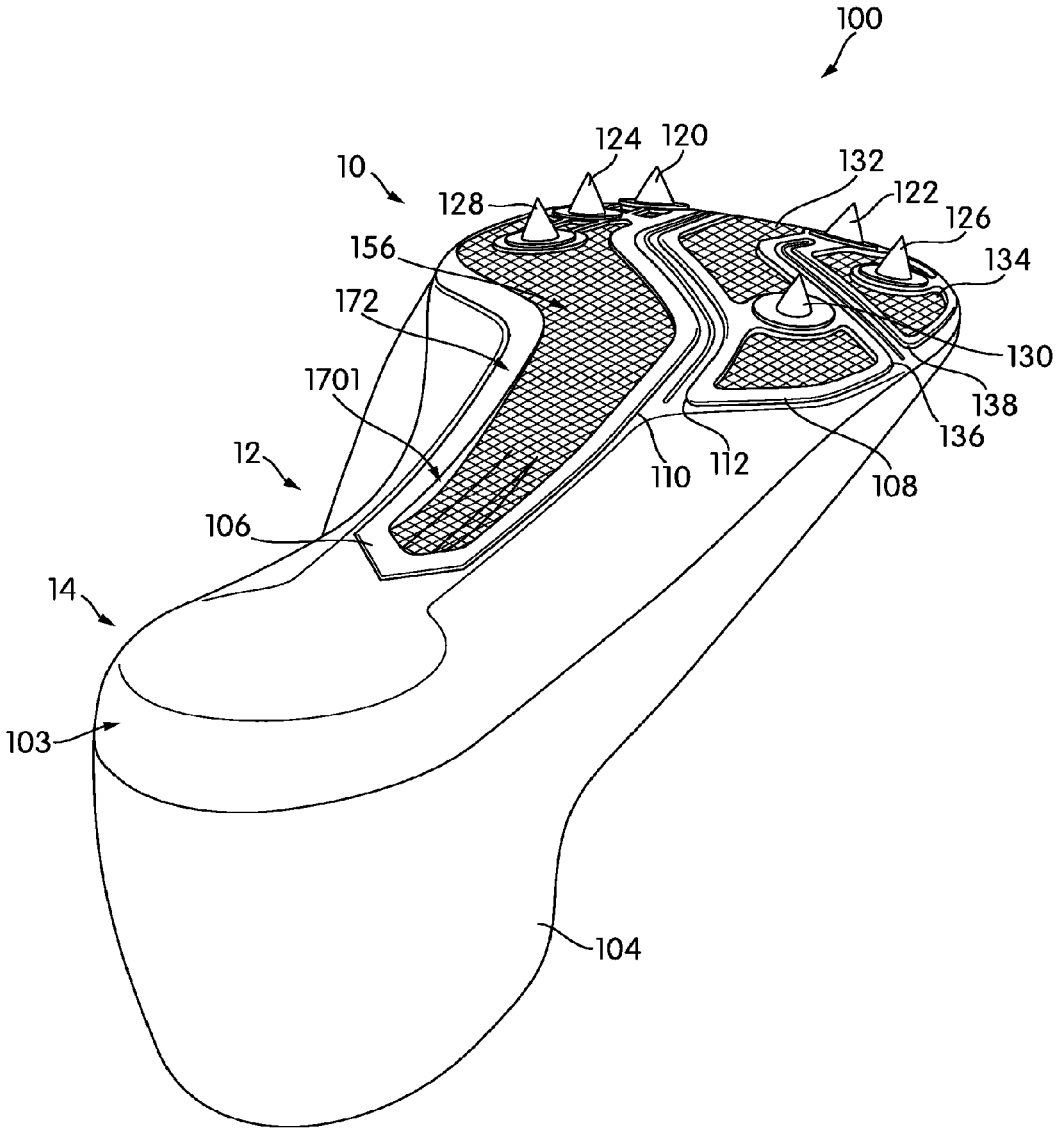
FIG. 17 is an isometric view of a second exemplary sole plate of the article of footwear of FIG. 1.

In some instances, further rigidity in the first plate 106 is desired to improve an amount of energy return during operation of the article 100. Accordingly, the first plate 106 may be formed to include a shape for increasing rigidity. For example, FIG. 17 illustrates a configuration of the article 100 that includes a concave portion 1701. As shown, concave portion 1701 extends into an exposed surface of the first plate 106. The shape of the concave portion 1701 may be substantially circular, rectangular, etc. In some configurations, the concave portion 1701 extends into the elastomer 172 but is separated from the first rigid member 156 by the elastomer 172. As such, the concave portion 1701 may further increase the rigidity of the first plate 106 to improve an amount of energy return during operation of the article 100.

Figure 18:
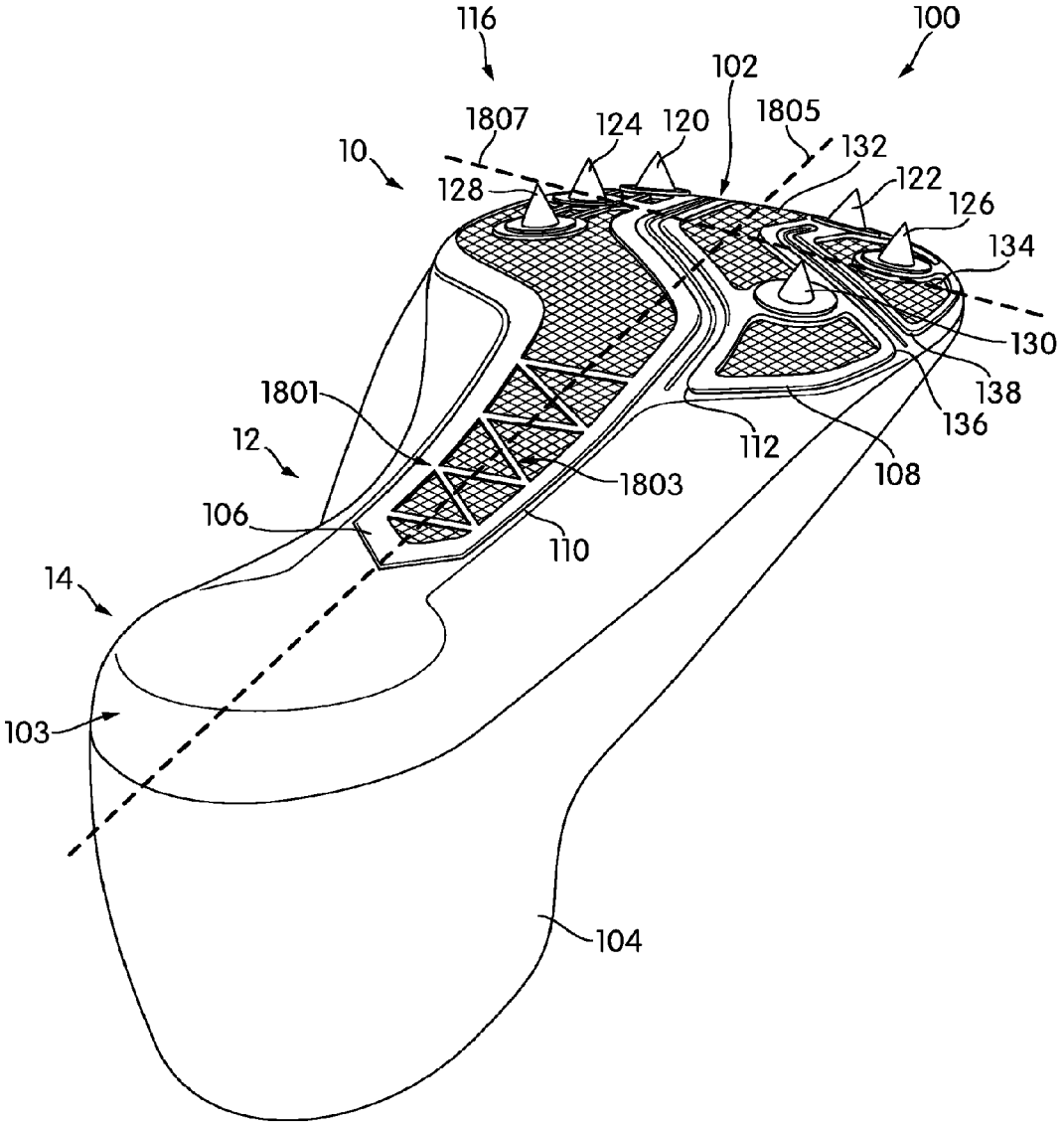
FIG. 18 is an isometric view of a third exemplary sole plate of the article of footwear of FIG. 1.

In some configurations, a cavity of the first plate 106 may include a portion having a shape to even further increase a rigidity of the first plate 106. For example, FIG. 18 illustrates a configuration of the article 100 that includes a crisscross portion 1801. As shown, the crisscross portion 1801 extends into an exposed surface of the first plate 106. In one configuration, the crisscross portion 1801 is formed in the concave portion 1701 (not shown). As shown, the crisscross portion 1801 is formed on the bottom surface 116 of sole plate 102. As such, the crisscross portion 1801 may even further increase rigidity in the sole plate 102 to improve an amount of energy return during operation of the article 100.

In one configuration, the crisscross portion 1801 includes lines oriented to further increase a rigidity of the sole plate 102. For instance, FIG. 18 illustrates lines (e.g., line 1803) of the crisscross portion 1801. The line 1803 may extend along a longitudinal axis 1805, along a lateral axis 1807, or substantially between the longitudinal axis 1805 and the lateral axis 1807. For example, FIG. 18 illustrates the line 1803 extending substantially between the longitudinal axis 1805 and the lateral axis 1807. As such, the line 1803 may even further increase rigidity in the sole plate 102 to improve an amount of energy return during operation of the article 100.

In some applications, it is desirable to have different flexibilities in different regions of an article. Such varying flexibilities may allow, for example, article 100 to be further customized to balance a user's comfort during operation and an energy return. For instance, a point of impact onto a playing surface may frequently occur in the forefoot portion 10 and rarely occur in the midfoot portion 12. Accordingly, the forefoot portion 10 may be configured to have a lower rigidity than the midfoot portion 12 to allow for improved user's comfort during operation. Similarly, the midfoot portion 12 may be configured to have a higher rigidity than the forefoot portion 10 to allow for a higher energy return.

Figure 19:
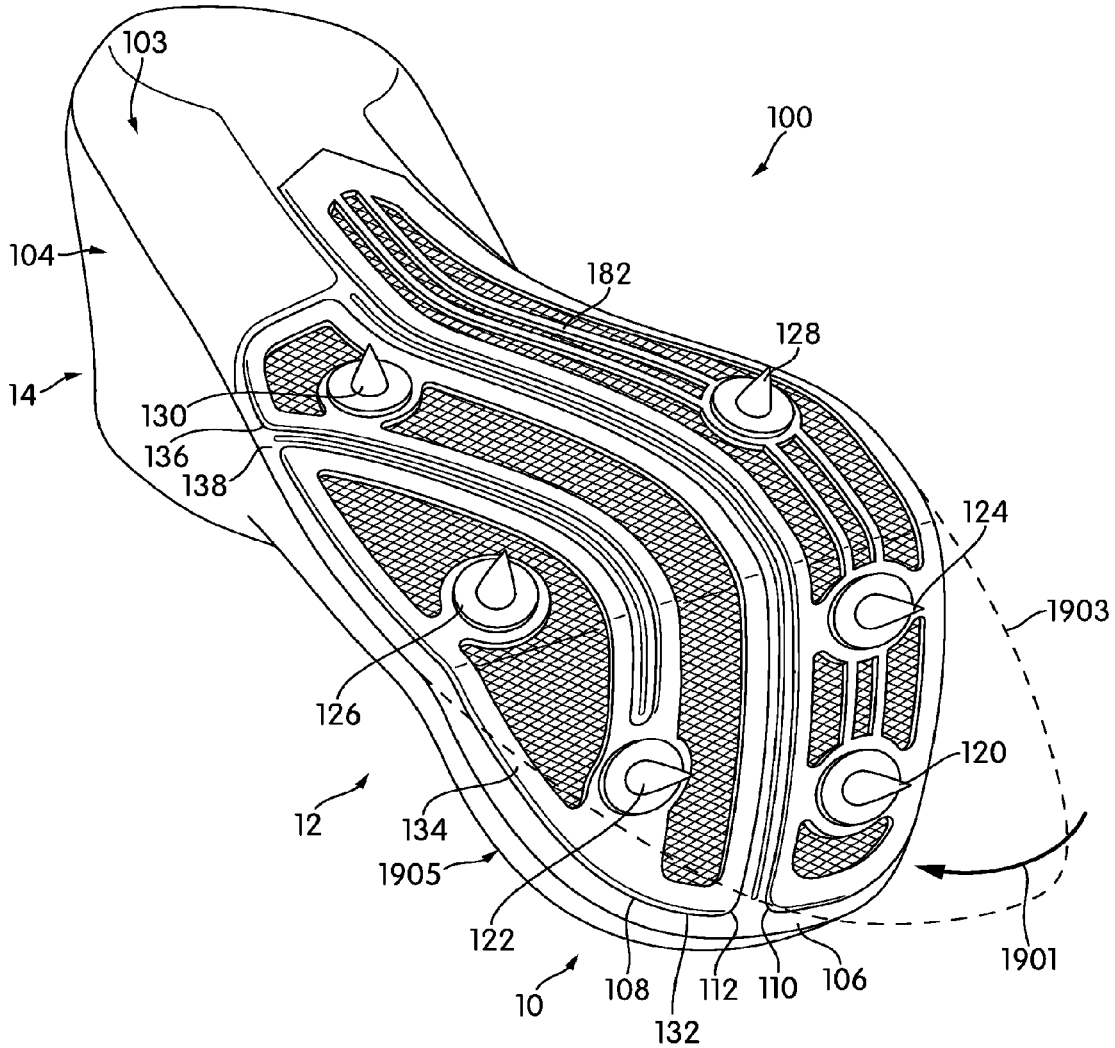
FIG. 19 is an isometric view of the sole plate of FIG. 1 illustrating a forefoot portion of the sole plate in a flexed state.
Figure 20:
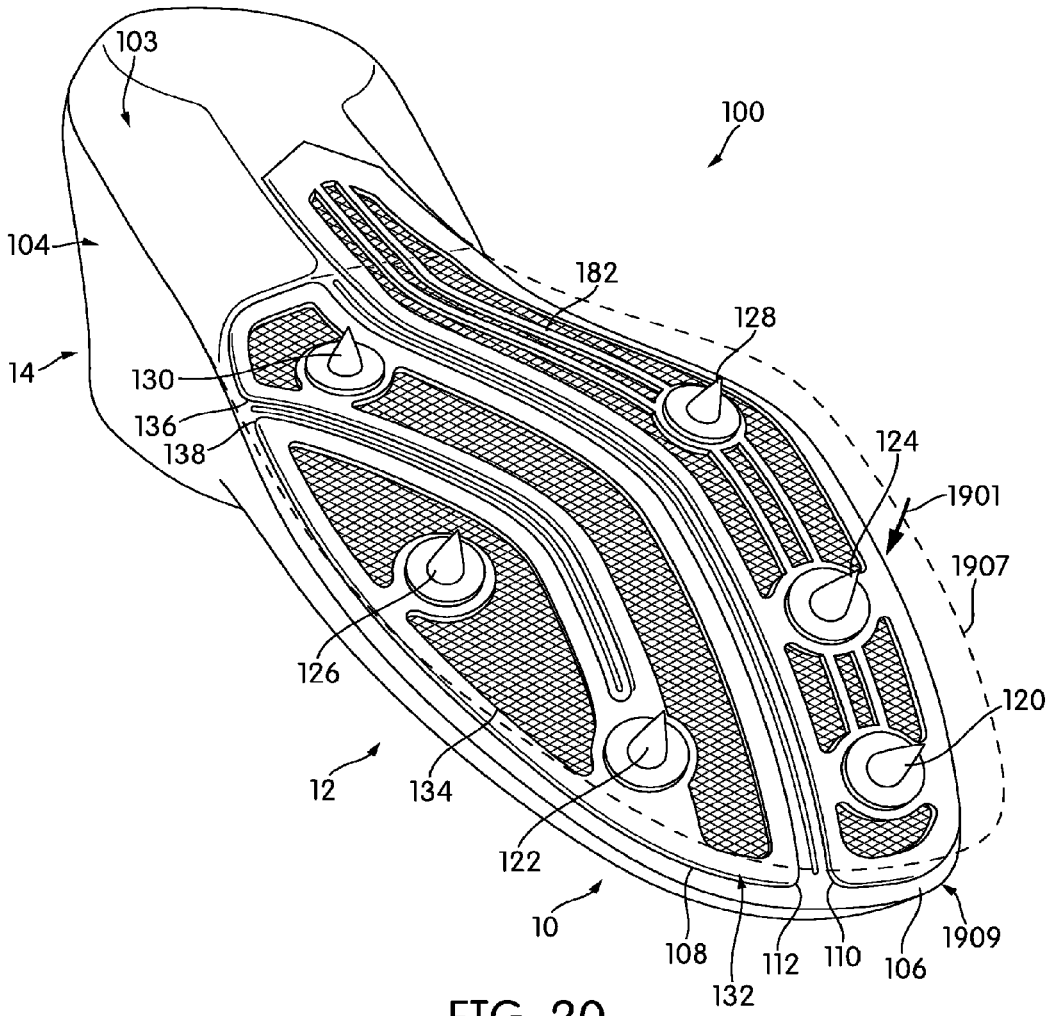
FIG. 20 is an isometric view of the sole plate of FIG. 1 illustrating a midfoot portion of the sole plate in a flexed state.

For example, FIGS. 19 and 20 illustrate an exemplary degree of flex in a forefoot portion 10 of the article 100 and a midfoot portion 12 of the article 100. As shown in FIG. 19, a force 1901 applied towards a forward end of forefoot portion 10 may cause the article 100 to bend from a rest forefoot position 1903 to a forced forefoot position 1905. As shown in FIG. 20, in some configurations, the force 1901 applied further back in forefoot portion 10 (compared to the location of force 1901 in FIG. 19) may cause the article 100 to bend from a rest midfoot position 1907 to a forced midfoot position 1909. As shown, the force 1901 causes the forefoot portion 10 to bend more than the midfoot portion 12. Accordingly, in some configurations, the article 100 may allow the user to have an improved feel of the playing surface (e.g., 701) during an impact of the forefoot portion 10 while maximizing an energy return in the midfoot portion 12.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper;

a midsole attached to the upper and including a first surface opposing the upper, a second surface formed on an opposite side of the midsole than the first surface, a forefoot portion, a midfoot portion, and a longitudinal axis extending from a toe portion to a heel portion;

a first sole plate extending along a medial side of the midsole from the forefoot portion through the midfoot portion and having a first reinforcement member formed from a first material that is more rigid than a material of the midsole and a first elastomer attaching the first reinforcement member to the midsole; and a second sole plate extending along a lateral side of the midsole and having a second reinforcement member formed from a second material that is more rigid than a material of the midsole, the second sole plate being spaced apart and separated from the first sole plate across a width of the midsole between the lateral side and the medial side by a first channel having a first end disposed in the toe portion and a second end disposed past a midpoint of the longitudinal axis in a direction toward the heel portion, the first channel separating the first elastomer from the second sole plate.

2. The article of footwear of claim 1, wherein the second sole plate includes a third reinforcement member formed from a third material that is more rigid than the material of the midsole.

3. The article of footwear of claim 2, wherein the third reinforcement member is spaced apart from the second reinforcement member.

4. The article of footwear of claim 2, wherein the second sole plate includes a second elastomer joining the second reinforcement member and the third reinforcement member, the second elastomer attaching the second sole plate and the third reinforcement member to the midsole.

5. The article of footwear of claim 4, further comprising a second channel formed into the second elastomer in an area between the second reinforcement member and the third reinforcement member, the second channel permitting relative movement between the second reinforcement member and the third reinforcement member.

6. The article of footwear of claim 5, further comprising a groove formed into the midsole within the second channel.

7. The article of footwear of claim 2, further comprising at least one cleat extending from the second sole plate and away from at least one of the second reinforcement member and the third reinforcement member.

8. The article of footwear of claim 1, further comprising a groove formed into the midsole within the first channel.

9. The article of footwear of claim 1, wherein the first reinforcement member is disposed between the midsole and the first sole plate and the second reinforcement member is disposed between the midsole and the second sole plate.

10. The article of footwear of claim 9, wherein at least one of the first reinforcement member and the second reinforcement member is exposed at a ground-contacting surface of at least one of the first sole plate and the second sole plate.

11. An article of footwear comprising:

an upper;

a midsole attached to the upper and including a first surface opposing the upper, a second surface formed on an opposite side of the midsole than the first surface, a forefoot portion, a midfoot portion, and a longitudinal axis extending from a toe portion to a heel portion;

a first sole plate extending along a medial side of the midsole from the forefoot portion through the midfoot portion, having a first reinforcement member formed from a first material that is different than a material of the midsole, and attached to the midsole by a first elastomer; and a second sole plate extending along a lateral side of the midsole, having a second reinforcement member formed from a second material that is different than a material of the midsole, and attached to the midsole by a second elastomer, the second sole plate operable to independently move relative to the first sole plate and being spaced apart and separated from the first sole plate across a width of the midsole between the lateral side and the medial side by a first channel having a first end disposed in the toe portion and a second end disposed past a midpoint of the longitudinal axis in a direction toward the heel portion, the first channel separating the first elastomer from the second sole plate.

12. The article of footwear of claim 11, wherein the second sole plate includes a third reinforcement member formed from a third material that is different than the material of the midsole.

13. The article of footwear of claim 12, wherein the third reinforcement member is spaced apart from the second reinforcement member.

14. The article of footwear of claim 12, wherein the second elastomer joins the second reinforcement member and the third reinforcement member, the second elastomer attaching the third reinforcement member to the midsole.

15. The article of footwear of claim 14, further comprising a second channel formed into the second elastomer in an area between the second reinforcement member and the third reinforcement member, the second channel permitting relative movement between the second reinforcement member and the third reinforcement member.

16. The article of footwear of claim 15, further comprising a groove formed into the midsole within the second channel.

17. The article of footwear of claim 12, further comprising at least one cleat extending from the second sole plate and away from at least one of the second reinforcement member and the third reinforcement member.

18. The article of footwear of claim 11, further comprising a groove formed into the midsole within the first channel.

19. The article of footwear of claim 11, further comprising at least one cleat extending from the first sole plate and away from the first reinforcement member.

20. The article of footwear of claim 11, wherein the first reinforcement member is disposed between the midsole and the first sole plate and the second reinforcement member is disposed between the midsole and the second sole plate.

21. The article of footwear of claim 20, wherein at least one of the first reinforcement member and the second reinforcement member is exposed at a ground-contacting surface of at least one of the first sole plate and the second sole plate.

* * * * *